US007481354B2

(12) United States Patent
Kawagoe et al.

(10) Patent No.: US 7,481,354 B2
(45) Date of Patent: Jan. 27, 2009

(54) PACKAGING CONTAINER AND METHOD FOR FOLDING UP THE SAME

(75) Inventors: Masahiro Kawagoe, Higashihiroshima (JP); Masako Kato, Higashihiroshima (JP)

(73) Assignee: Sharp Kabushiki Kaisha, Osaka (JP)

( * ) Notice: Subject to any disclaimer, the term of this patent is extended or adjusted under 35 U.S.C. 154(b) by 427 days.

(21) Appl. No.: 10/654,486

(22) Filed: Sep. 4, 2003

(65) Prior Publication Data

US 2005/0087590 A1 Apr. 28, 2005

(30) Foreign Application Priority Data

Jan. 28, 2003 (JP) ..... 2003-018108
Jul. 8, 2003 (JP) ..... 2003-193461

(51) Int. Cl.
*B65D 5/36* (2006.01)

(52) U.S. Cl. ..... 229/117.01; 229/185; 229/157; 229/156; 229/117.05

(58) Field of Classification Search ..... 229/117.01, 229/117.05, 117.06, 165
See application file for complete search history.

(56) References Cited

U.S. PATENT DOCUMENTS 1,481,592 A * 1/1924 Dozier ..... 229/117.05
1,999,940 A * 4/1935 MacDonald ..... 206/815
2,594,394 A * 4/1952 Casselman et al. ..... 229/117.01
2,805,516 A * 9/1957 Palm ..... 446/79
3,021,042 A * 2/1962 Stumpf, Jr. ..... 229/5.5
3,565,325 A * 2/1971 Pugsley et al. ..... 229/117.05
4,094,458 A * 6/1978 Nelson, Jr. ..... 229/117
4,760,922 A * 8/1988 Northgrave ..... 206/600
4,801,080 A * 1/1989 Spengler ..... 229/125.19
4,830,270 A * 5/1989 Holmes ..... 229/102
4,834,255 A * 5/1989 Boots ..... 229/199
5,104,035 A * 4/1992 Rosenbaum, II ..... 229/157
5,328,088 A * 7/1994 Lonczak ..... 229/157
5,542,541 A * 8/1996 Smith ..... 206/600
6,598,783 B2 * 7/2003 Brinkman ..... 229/116.1

FOREIGN PATENT DOCUMENTS

CN 2423208 Y 3/2001
FR 2739837 A1 4/1997
JP 57-167016 U 10/1982
JP 59-080214 U 5/1984
JP 61-56226 4/1986
JP 62-110119 5/1987

(Continued)

*Primary Examiner*—Tri M Mai
(74) *Attorney, Agent, or Firm*—Birch, Stewart, Kolasch & Birch, LLP

(57) ABSTRACT

A packaging container includes: first fold sections for folding therealong, each of the first fold sections being provided longitudinally in a substantially central part of the first opposing side plate; second fold sections for folding therealong, each of the second fold sections being provided on the first bottom plate forming flap as an extension of the first fold section; and third fold sections for folding therealong, each of the third fold sections being provided on the first top cover forming flap as an extension of the first fold section. The second opposing side plate is equal to or smaller than the first opposing side plate in width. This makes it possible to fold up the packaging container easily and compactly.

16 Claims, 32 Drawing Sheets

FOREIGN PATENT DOCUMENTS

| | | | | |
|---|---|---|---|---|
| JP | 62-110119 | U | | 7/1987 |
| JP | 9-132230 | A | | 5/1997 |
| JP | 10-129672 | A | | 5/1998 |
| JP | 11-227744 | A | | 8/1999 |
| JP | 2002-46728 | | * | 2/2002 |
| JP | 2002-284145 | A | | 10/2002 |
| NL | 1009622 | | | 1/2000 |

* cited by examiner

PACKAGING CONTAINER AND METHOD FOR FOLDING UP THE SAME

This nonprovisional application claims priority under 35 U.S.C.§ 119(a) on Patent Application No(s). 2003-18108 and 2003-193461 filed in JAPAN on Jan. 28, 2003 and Jul. 8, 2003, which is(are) herein incorporated by reference.

BACKGROUND OF THE INVENTION

1. Field of the Invention

The present invention relates to a packaging container for storing an article and a method for folding up the packaging container.

2. Description of the Related Art

Conventionally, a cardboard packaging container for storing a large size article to be packaged, especially when recycled or disposed as waste, is cut into small pieces, for example, by breaking with user's fingers to put them into a synthetic-resin disposal bag, or is forced to fold up into a decreased bulk to hold a folded state of the container with a sealing tape or a string.

However, it requires a lot of muscle and much time to break the cardboard into small pieces with user's fingers. Further, when the cardboard packaging container is forced to fold up into a decreased bulk, it must be folded up at a part where there are no fold lines, also requiring a lot of muscle. Still further, it requires much time to wind the container with a sealing tape or a string while holding the folded state of the container, resulting in a burdensome folding operation.

In order to solve such problems, a packaging container disclosed in Japanese Unexamined Utility Model Application Publication No. 56226/1986 (Jitsukaisho 61-56226; published on Apr. 15, 1986) is known as a packaging container enabling flat folding and convenient for disposal as waste.

However, although the packaging container disclosed in the conventional publication is provided with a perforated cut line along a fold line on the flap, which enables flat folding by opening along the perforated cut line, it requires a lot of muscle to fold at a part where there are no fold lines on each plate as the above-described folding manner as well as requires much time to fold compactly at the midpoint of each plate as the above-described folding manner.

SUMMARY OF THE INVENTION

An object of the present invention is to provide a packaging container and a method for folding up the packaging container which can be folded up easily and compactly for disposal as waste, recycling, and other purposes.

In order to achieve the above object, a packaging container of the present invention includes a pair of first opposing side plates and a pair of second opposing side plates surrounding a package space, the packaging container further comprising:

first bottom plate forming flaps for forming a bottom plate, each of the first bottom plate forming flaps being connected to a lower end of the first opposing side plate; and first top cover forming flaps for forming a top plate, each of the first top cover forming flaps being connected to an upper end of the first opposing side plate, wherein the first opposing side plate, the first bottom plate forming flap, and the first top cover forming flap are provided with one continuous longitudinal fold section thereacross in a substantially central part in a width direction of the first opposing side plate, and wherein at least one flap of a second bottom plate forming flap and a second top cover forming flap which are respectively connected to a lower end and an upper end of at least one of the second opposing side plates is provided with a lateral fold section which is substantially parallel to a connection line between the second opposing side plate and the at least one flap, the at least one flap being folded along the lateral fold section to insert a leading end part of the at least one flap when the packaging container is folded up.

According to the above invention, flaps except for the bottom plate forming flap and the top cover forming flap which are connected respectively to the lower end and the upper end of the one of the second opposing side plates are overlapped the respective opposing side plates connected to the flaps. At this moment, at least the bottom plate forming flap and the top cover forming flap which are connected respectively to the lower end and the upper end of the other of the second opposing side plates are folded so as to overlap the inner surface of the other of the second opposing side plates. In this state, the first opposing side plates, and the bottom plate forming flaps and the top cover forming flaps which are connected respectively to the first opposing side plates are folded inward in the form of the letter V along the respective fold lines, and the insertion pieces are inserted inside the other of the second opposing side plates.

This makes it possible to provide a packaging container which can be folded up easily and compactly for disposal as waste, recycling, and other purposes.

Still further, in order to achieve the above object, a packaging container of the present invention includes a pair of first opposing side plates and a pair of second opposing side plates surrounding a package space, the packaging container further comprising:

first bottom plate forming flaps for forming a bottom plate, each of the first bottom plate forming flaps being connected to a lower end of the first opposing side plate;

first top cover forming flaps for forming a top plate, each of the first top cover forming flaps being connected to an upper end of the first opposing side plate;

first fold sections for folding therealong, each of the first fold sections being provided longitudinally in a substantially central part of the first opposing side plate;

second fold sections for folding therealong, each of the second fold sections being provided on the first bottom plate forming flap as an extension of the first fold section; and third fold sections for folding therealong, each of the third fold sections being provided on the first top cover forming flap as an extension of the first fold section, the second opposing side plate being equal to or smaller than the first opposing side plate in width.

According to the above invention, in folding up the packaging container, it is possible to fold in the form of the letter V along the respective first fold sections of the first opposing side plates, the respective second fold sections of the first bottom plate forming flaps, and the respective third fold sections of the first top cover forming flaps.

At this moment, in the present invention, the second opposing side plate is equal to or smaller than the first opposing side plate in width, so that it is possible to fold up the packaging container into a decreased area, as compared with the case where the second opposing side plate is larger in width than the first opposing side plate.

Therefore, it is possible to provide a packaging container which can be folded up easily and compactly for disposal as waste, recycling, and other purposes.

Yet further, in order to achieve the above object, a method for folding up a packaging container of the present invention includes:

a pair of first opposing side plates and a pair of second opposing side plates;

bottom plate forming flaps connected to respective lower ends of the first and second opposing side plates;

top cover forming flaps connected to respective upper ends of the first and second opposing side plates; and longitudinal fold sections each being provided across the first opposing side plate, the bottom plate forming flap connected to the lower end of the first opposing side plate, and the top cover forming flap connected to the upper end of the first opposing side plate, the longitudinal fold section being substantially orthogonal to respective connection lines between the first opposing side plate and the bottom plate forming flap and between the first opposing side plate and the top cover forming flap; and a lateral fold section being provided on the top cover forming flap connected to an upper end of at least one of the second opposing side plates, the lateral fold section being substantially parallel to a connection line to the second opposing side plate, the method comprising the steps of:

folding the bottom plate forming flap and the top cover forming flap respectively connected to a lower end and an upper end of the other of the second opposing side plates so as to overlap an inner surface of the other of the second opposing side plates;

folding each of the bottom plate forming flaps and each of the top cover forming flaps respectively connected to the lower end and the upper end of the first opposing side plate so as to overlap an inner or outer surface of the first opposing side plate; and while maintaining a state where the first opposing side plate, and the bottom plate forming flap and the top cover forming flap connected to the first opposing side plate are inwardly folded in a form of the letter V along the longitudinal fold section, inserting the bottom plate forming flap connected to the lower end of the at least one of the second opposing side plates and an insertion piece of a leading end part ahead of the lateral fold section of the top cover forming flap connected to the upper end of the at least one of the second opposing side plates inside the other of the second opposing side plates.

According to the above invention, the insertion piece for holding a folded state extends from at least one of the upper end and the lower end of the second opposing side plate, so that it is possible to insert the insertion piece inside the other of the second opposing side plates in the folded packaging container. This maintains a folded state of the packaging container without opening out again by itself.

Therefore, it is possible to provide a packaging container and a method for folding up the packaging container which can be folded up easily and compactly for disposal as waste, recycling, and other purposes.

For a fuller understanding of the nature and advantages of the invention, reference should be made to the ensuing detailed description taken in conjunction with the accompanying drawings.

DESCRIPTION OF THE EMBODIMENTS

First Embodiment

The following will describe one embodiment of the present invention with reference to FIGS. 1 through 8.

Figure 1:
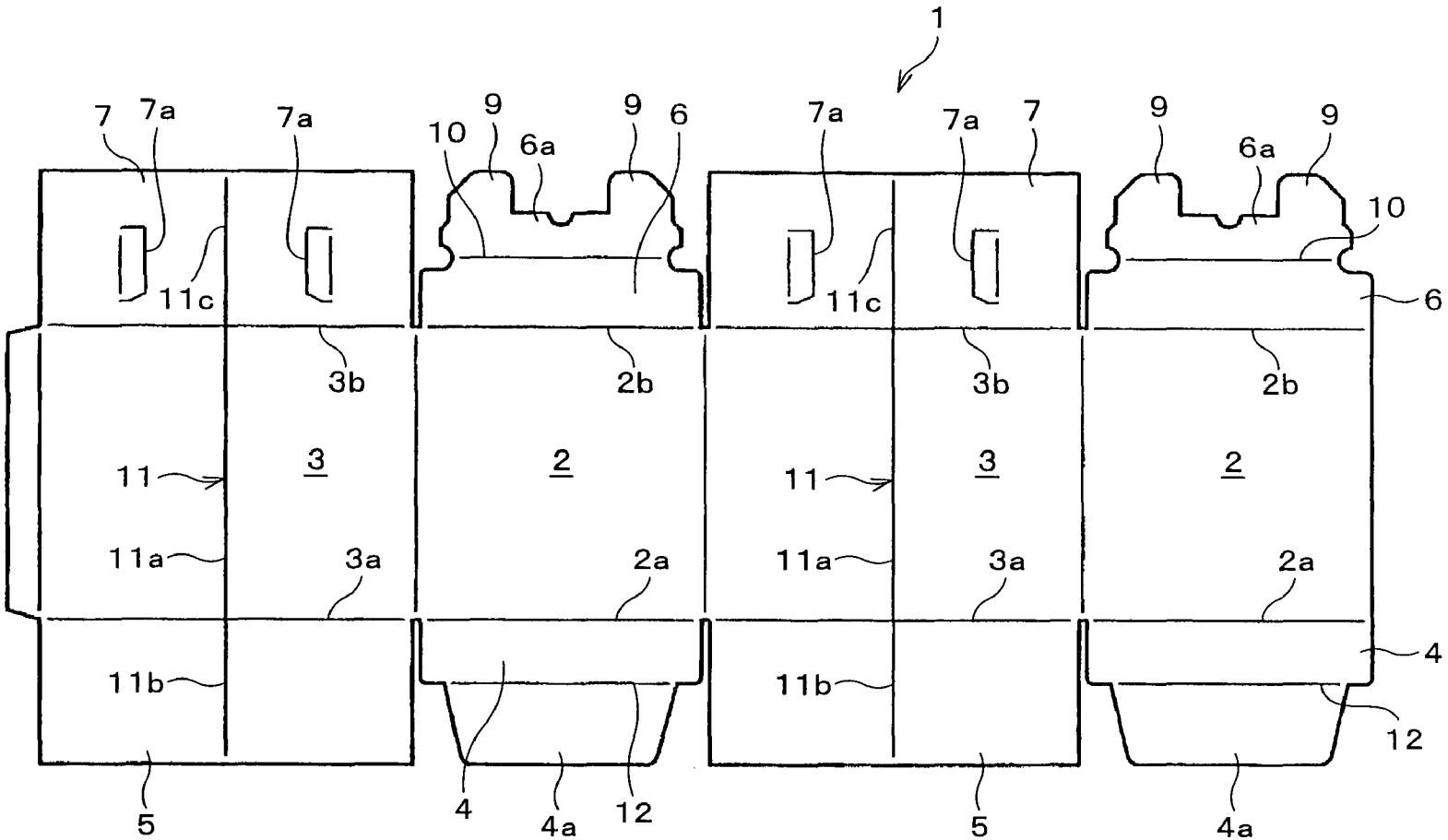
FIG. 1 is a developed view showing a packaging container of one embodiment of the present invention.

A packaging container 1 of the present embodiment, as shown in FIG. 1, includes a pair of second opposing side plates 2, a pair of first opposing side plates 3, second bottom plate forming flaps 4 connected respectively to the lower ends of the second opposing side plates 2, first bottom plate forming flaps 5 connected respectively to the lower ends of the first opposing side plates 3, second top cover forming flaps 6 connected respectively to the upper ends of the second opposing side plates 2, and first top cover forming flaps 7 connected respectively to the upper ends of the first opposing side plates 3. Note that, a shape of the packaging container 1 is, but not limited to, rectangle or square. Moreover, the packaging container 1 according to the present embodiment is made of cardboard. However, the material of the packaging container 1 is not limited to cardboard, and any material may be adopted so long as it is foldable material, such as paper and plastic.

The pair of second opposing side plates 2 and the pair of first opposing side plates 3 are alternately connected to one another, forming a situation where four side plates are continuously connected to one another to surround a packaging space on all four sides. The second opposing side plates 2 are set to be equal to or smaller than the first opposing side plates 3 in width. The first bottom plate forming flaps 5 are provided respectively to the lower ends 3*a* of the first opposing side plates 3, and the second bottom plate forming flaps 4 are provided respectively to the lower ends 2*a* of the second opposing side plates 2.

Figure 2:
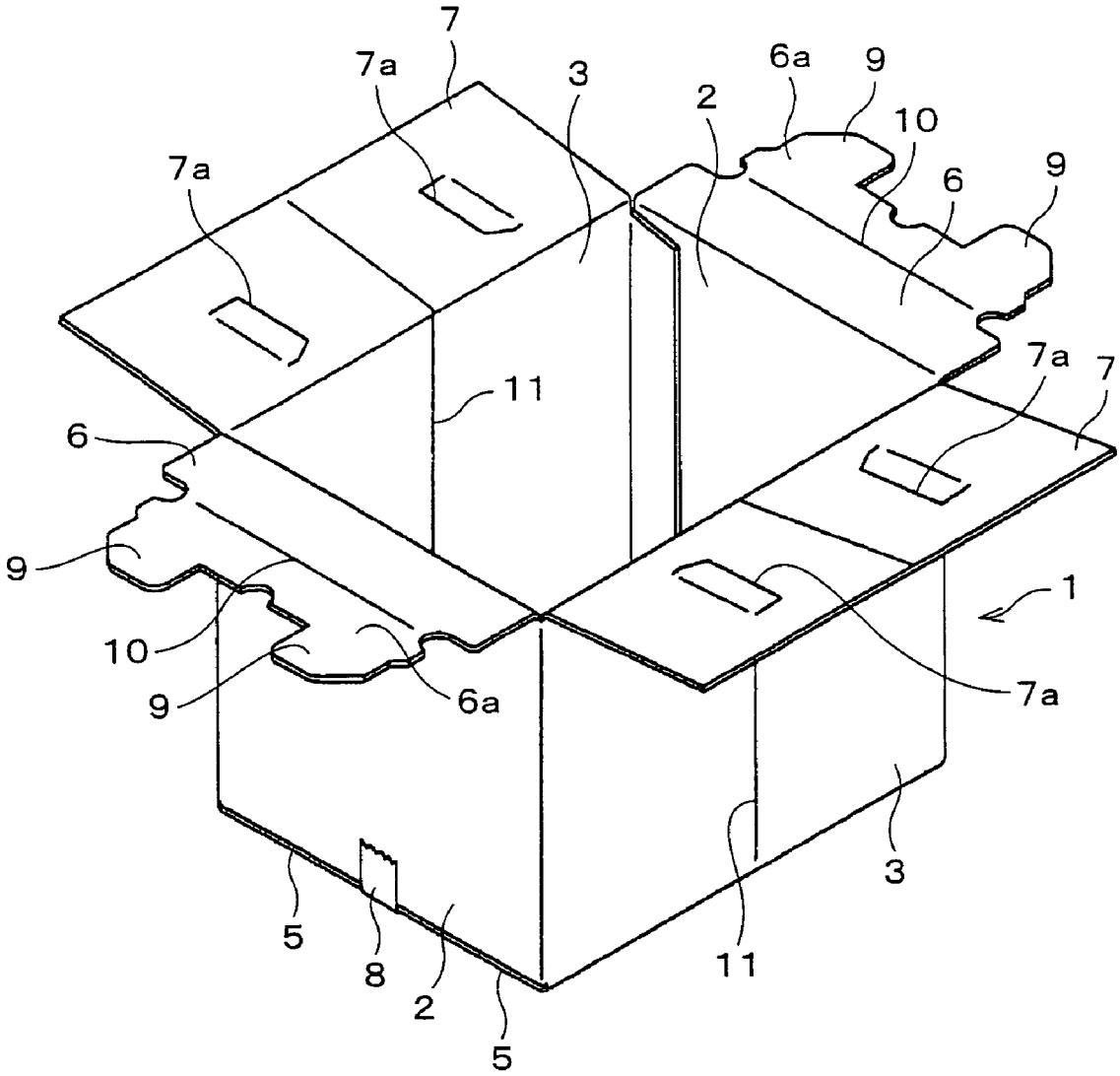
FIG. 2 is a general perspective view showing a state of the packaging container before an article to be packaged is stored therein.

The second bottom plate forming flaps 4 and the first bottom plate forming flaps 5 form overlap structure of a bottom plate in the packaging container 1. Specifically, after the second bottom plate forming flaps 4 are folded, the first bottom plate forming flaps 5 are folded, thereby forming the bottom plate. In this regard, abutting parts of the first bottom plate forming flaps 5, as shown in FIG. 2, are sealed with a sealing tape 8. Note that, material of the sealing tape 8 is not especially limited so long as it is material that can hold the abutting parts, such as packing tape and paper tape.

Figure 3:
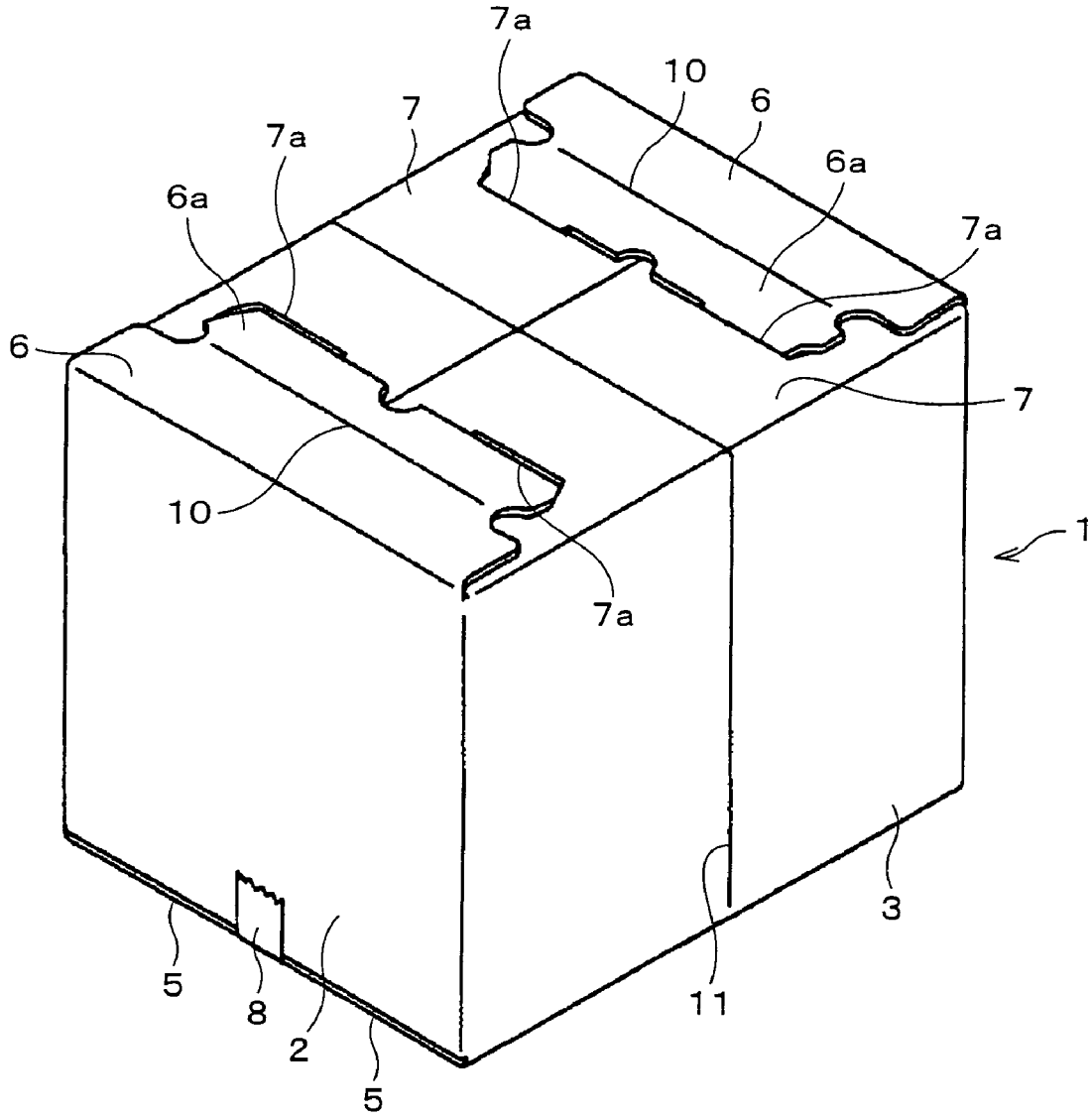
FIG. 3 is a perspective view showing a state of the packaging container when an article to be packaged is stored therein.

Meanwhile, the first top cover forming flaps 7 are connected respectively to the upper ends 3*b* of the first opposing side plates 3, and the second top cover forming flaps 6 are connected respectively to the upper ends 2*b* of the second opposing side plates 2. As shown in FIG. 3, the second top cover forming flaps 6 and the first top cover forming flaps 7 form overlap structure of a top cover in the packaging container 1. Specifically, after the first top cover forming flaps 7 are folded with their edges abutting, the second top cover forming flaps 6 are folded and, tabs 9 (see FIG. 1) provided on each of the second top cover forming flaps 6 are inserted respectively into slits 7*a* provided on each of the first top cover forming flaps 7, thereby forming the top cover.

More specifically, the second top cover forming flaps 6 are folded so as to be astride the two first top cover forming flaps 7, and the tabs 9 are inserted into the respective slits 7*a* provided on the two first top cover forming flaps 7, thereby maintaining a closed state of the top cover. This arrangement makes it possible to maintain a closed state of the top cover simply without using a tape such as the sealing tape 8.

Each of the second top cover forming flaps 6 is provided with a fold section 10 along which the top cover forming flap 6 itself can be fold, substantially in parallel with a connection line of the upper end 2*b* of the second opposing side plate 2. This facilitates the insertion of the tabs 9 into the respective slits 7*a*. Specifically, folding the second top cover forming flaps 6 along the respective fold sections 10 facilitates the insertion of the tabs 9 into the respective slits 7*a*.

Further, the fold sections 10 are used to form insertion pieces 6*a* in folding up the packaging container 1. Note that, the fold section 10 is preferably formed as typical ruled line. However, it may be formed in a perforated or serrated manner, and any type of form may be adopted as long as it is foldable therealong.

Meanwhile, the first opposing side plates 3, as shown in FIG. 1, are provided with respective first fold sections 11*a* in a substantially central position across the width direction of the first opposing side plates 3. The first fold sections 11*a* are substantially parallel to the longitudinal direction of the first opposing side plates 3, and the first opposing side plates 3 themselves can be folded along the first fold sections 11*a*. Further, the first bottom plate forming flaps 5 are provided with respective second fold sections 11*b* in a substantially central part across the width direction of the first bottom plate forming flaps 5. The second fold sections 11*b* are provided respectively in a form of continuing into the first fold sections 11*a*, i.e. as an extension of the first fold sections 11*a*, and the first bottom plate forming flaps 5 themselves can be folded along the second fold sections 11*b*.

Moreover, the first top cover forming flaps 7 are provided with respective third fold sections 11*c* in a substantially central part across the width direction of the first top cover forming flaps 7. The first top cover forming flaps 7 are provided respectively in a form of continuing into the first fold sections 11*a*, and the first top cover forming flaps 7 themselves can be folded along the third fold sections 11*c*.

The three fold sections: the first fold section 11*a*, the second fold section 11*b*, and the third fold section 11*c*, which are provided continuously, constitute one continuous fold section 11. A preferable form of the fold section 11 is, for example, a line with a fold made in advance, a line with recessed parts, and a line with a series of small cuts halfway the thickness direction of the fold sections 11*a*, 11*b*, and 11*c*. Also, a line with perforations made in advance is preferable.

Meanwhile, the second bottom plate forming flaps 4, as shown in FIG. 1, are provided with respective fold sections 12 each of which is substantially parallel to the lower end 2*a* of the second opposing side plate 2. The leading end parts ahead of the fold sections 12 of the second bottom plate forming flaps 4 are cut tapered on their opposite sides and adapted to be used as insertion pieces 4*a*. The insertion pieces 4*a* are used in folding the packaging container 1. Note that, the fold section 12 can be provided on at least one of the second bottom plate forming flaps 4. Further, although the fold section 12 is preferably formed as typical ruled line, it may be formed in a perforated or serrated manner.

The following will describe a process for folding up the packaging container 1 in the above arrangement.

Figure 4:
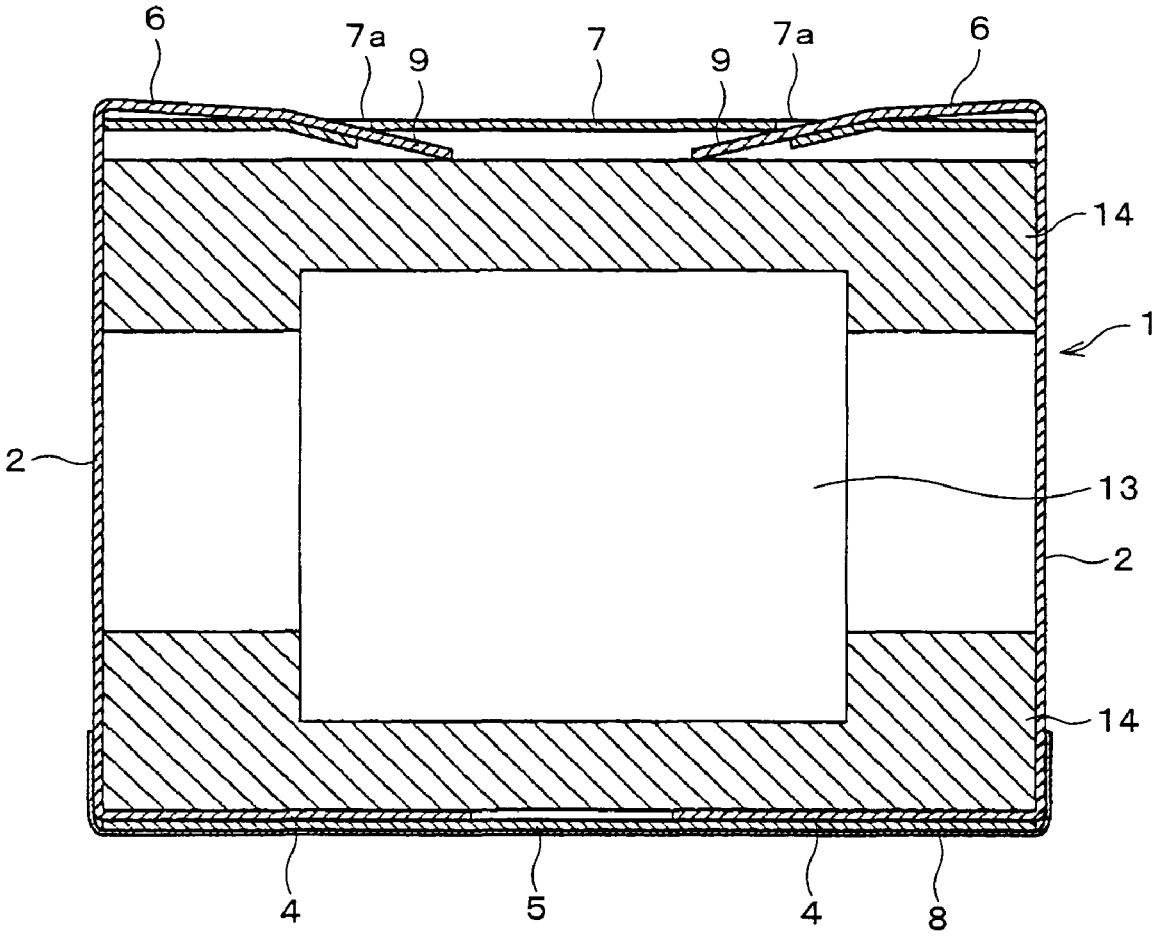
FIG. 4 is a cross-sectional view showing a state of the packaging container when an article to be packaged is stored therein.

As shown in FIG. 4, a packaged article 13 protected by cushioning material 14, for example, is stored inside the assembled packaging container 1. Note that, it is preferable that the cushioning material 14 is made of foaming polystyrol, and it may be made of cardboard and the like. However, any material may be used for the cushioning material 14.

Figure 5:
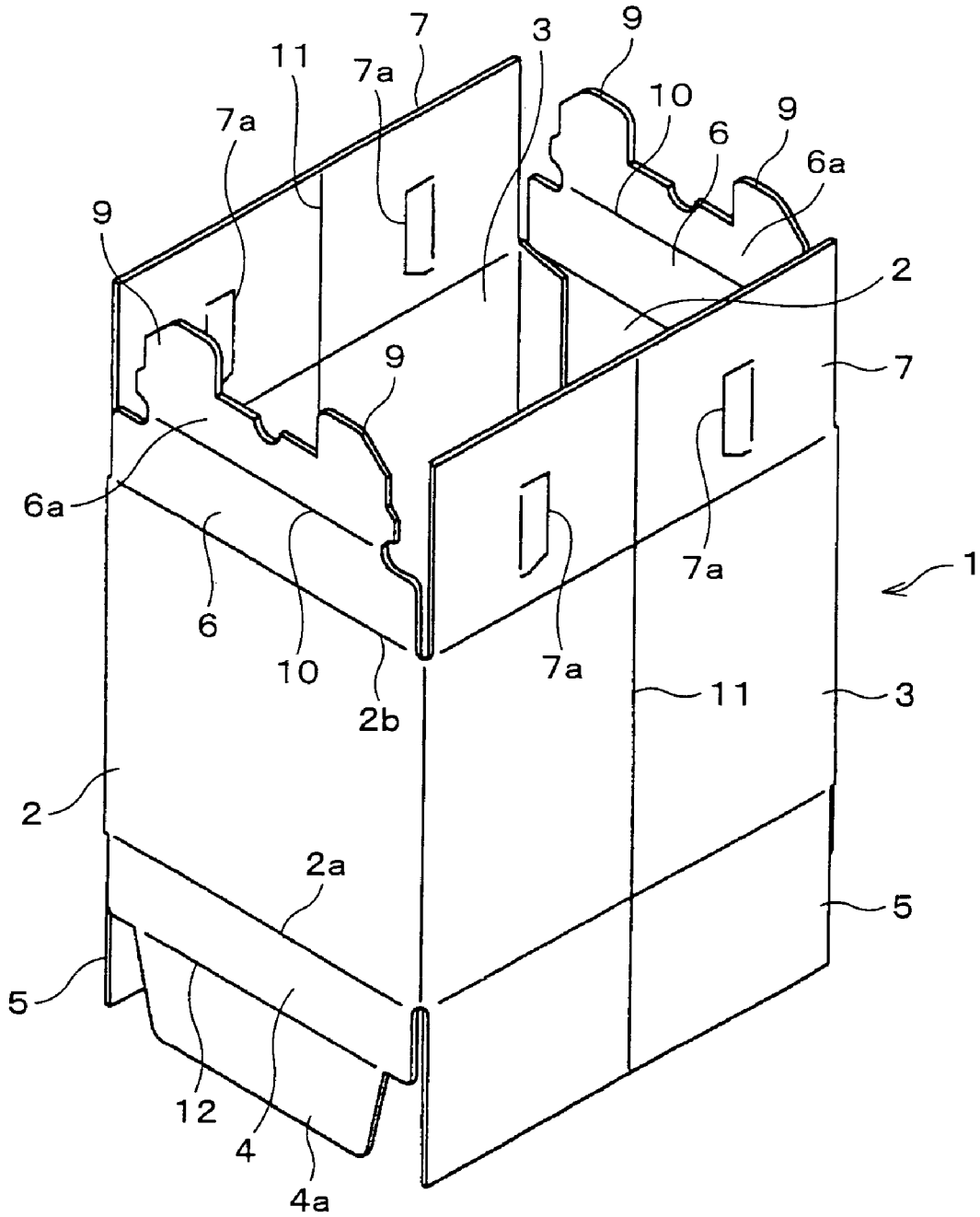
FIG. 5 is a perspective view showing a state of the packaging container standing in a cylindrical manner to fold up the packaging container.

The packaged article 13 and the cushioning material 14 are taken out of the packaging container 1 while the second top cover forming flaps 6 and the first top cover forming flaps 7 are kept opened. Next, the sealing tape 8 is peeled away and, as shown in FIG. 5, the first and second bottom plate forming flaps 5 and 4 and the first and second top cover forming flaps 7 and 6 are opened to become flush with respect to the two pairs of first and second opposing side plates 3 and 2, so as to make the packaging container 1 in a cylindrical manner.

With this state, it is preferable that while the second bottom plate forming flap 4 and the second top cover forming flap 6 which are respectively connected to the lower end 2*a* and the upper end 2*b* of one of the second opposing side plates 2 are left unfold, all of the other flaps, i.e. the other of the second bottom plate forming flaps 4, the first bottom plate forming flaps 5, the other of the second top cover forming flaps 6, and the first top cover forming flaps 7, are folded so as to overlap the other of the second opposing side plates 2 and the first opposing side plates 3, respectively, connected thereto.

Figure 6:
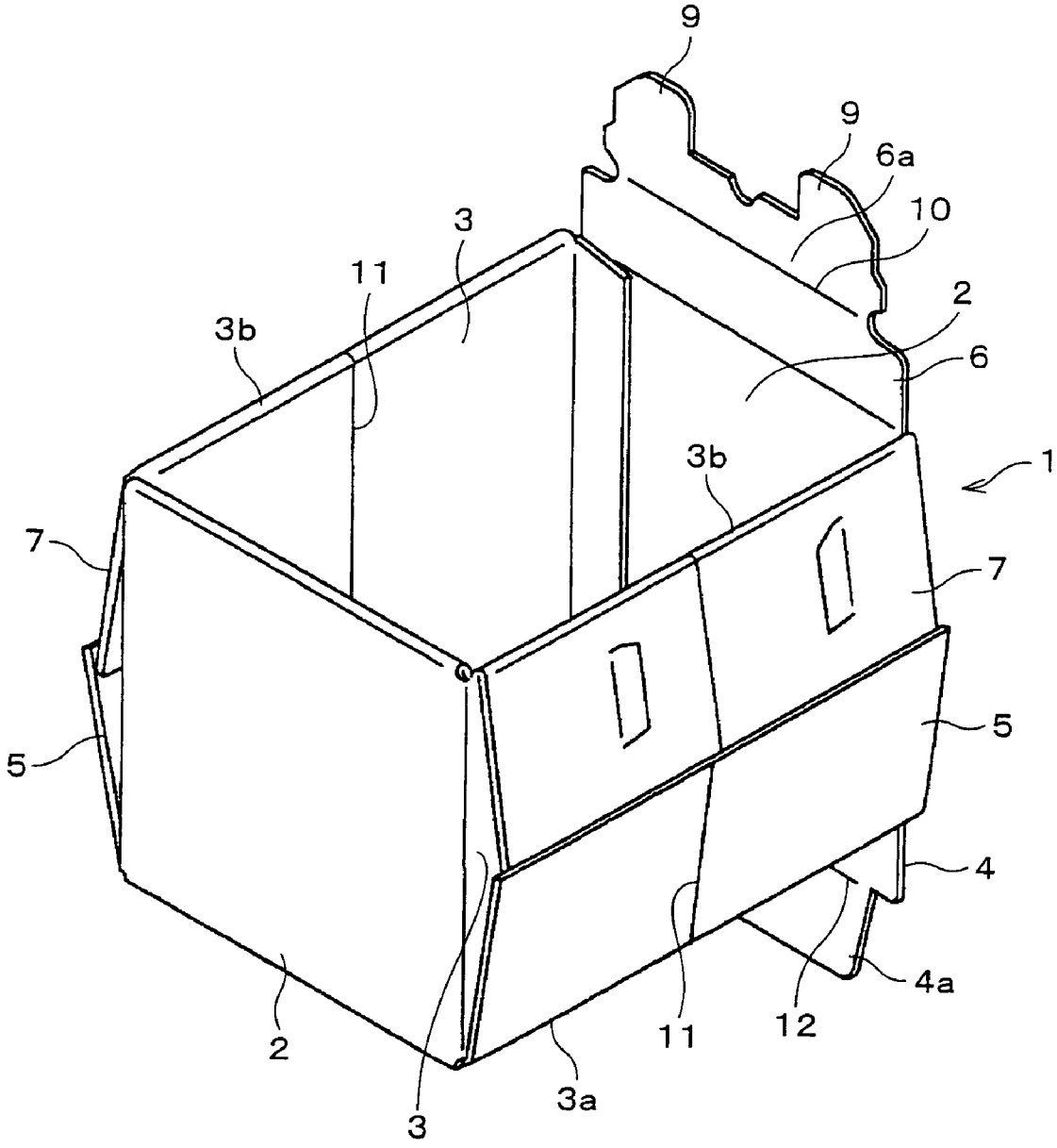
FIG. 6 is a perspective view showing a state of the packaging container in progress in folding up.

More specifically, the second bottom plate forming flap 4 and the second top cover forming flap 6 which are respectively connected to the lower end 2*a* and the upper end 2*b* of one of the second opposing side plates 2 are folded inward so as to overlap the inner surface of the other of the second opposing side plates 2. Further, as shown in FIG. 6, the first bottom plate forming flaps 5 and the first top cover forming flaps 7 each of which are respectively connected to the lower end 3*a* and the upper end 3*b* of the first opposing side plate 3 are folded outward so as to overlap the outer surface of the first opposing side plate 3. Note that, the first bottom plate forming flaps 5 and the first top cover forming flaps 7 each may be folded inward so as to overlap the inner surfaces of the first opposing side plates 3, respectively.

Figure 7:
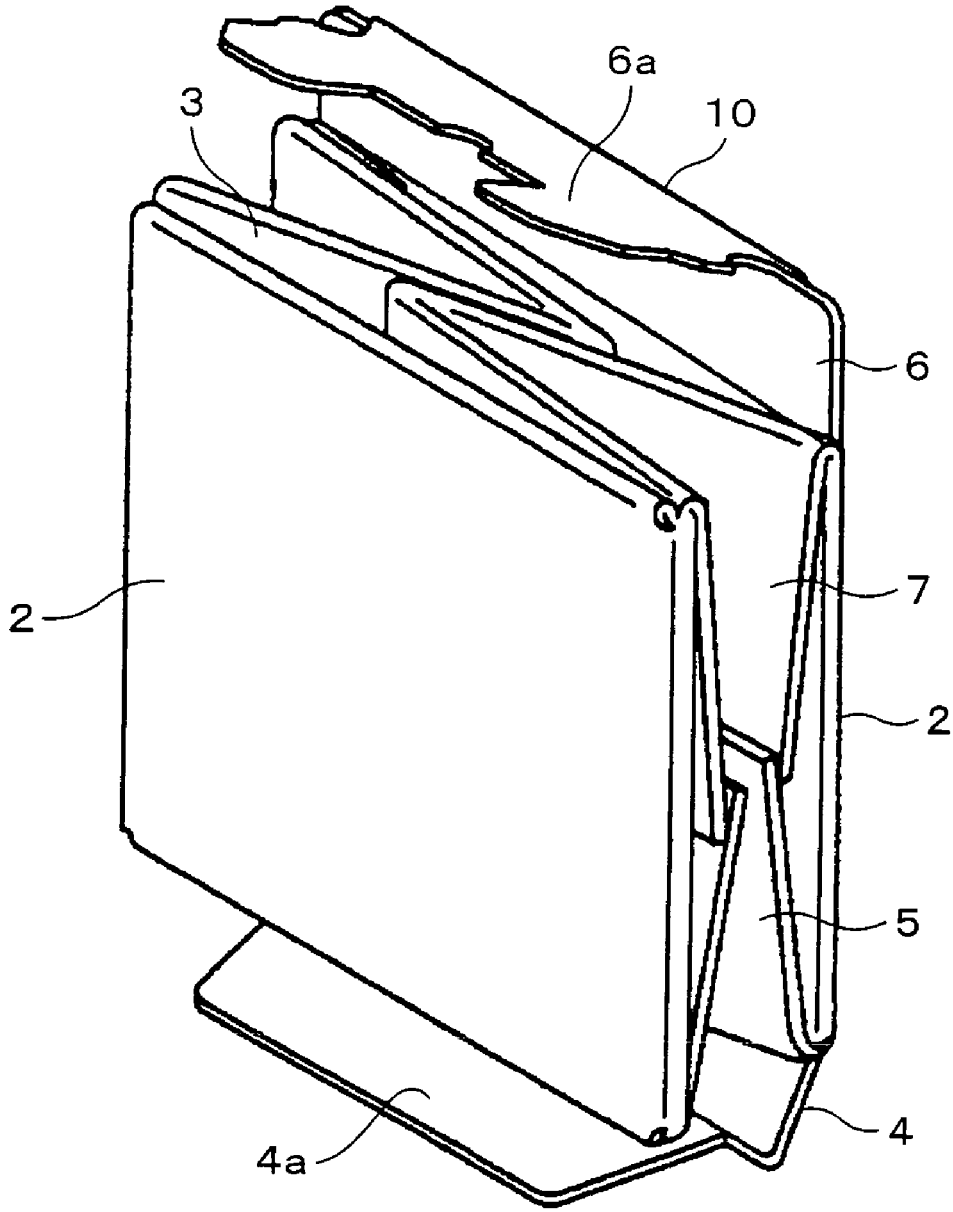
FIG. 7 is a perspective view showing a state of the packaging container folded up so that its opposing side plates are in the form of the letter V.

In such a state, as shown in FIG. 7, the first opposing side plates 3, the first bottom plate forming flaps 5, and the first top cover forming flaps 7 are inwardly folded in the form of the letter V at the fold sections 11 inside the packaging container 1 so as to be sandwiched between the second opposing side plates 2.

Figure 8:
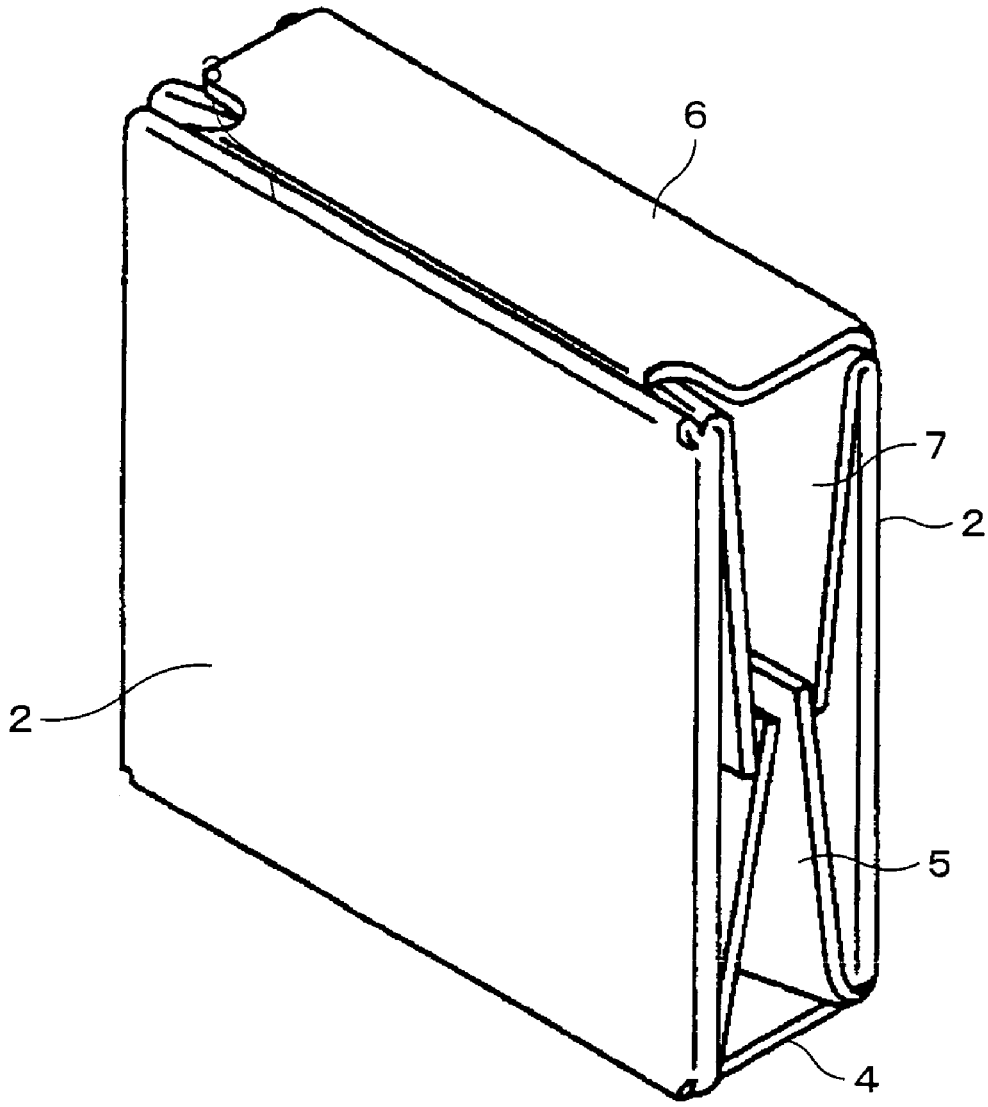
FIG. 8 is a perspective view showing a state of the packaging container folded up by inserting insertion pieces.

Next, the insertion piece 4*a* is formed by folding along the fold section 12 that is provided on the second bottom plate forming flap 4, and the insertion piece 6*a* is formed by folding along the fold sections 10 that is provided on the second top cover forming flap 6. The insertion pieces 4*a* and 6*a*, as shown in FIG. 8, are inserted inside the other of the second opposing side plates 2. More specifically, the insertion pieces 4*a* and 6*a* are inserted so as to respectively overlap the other of the second bottom plate forming flaps 4 and the other of the second top cover forming flaps 6 that have been folded so as to overlap the inner surface of the other of the opposing side plate 2.

This brings the packaging container 1 in a compactly folded state. Since the insertion pieces 4*a* and 6*a* of the one of the second opposing side plates 2 are inserted inside the other of the second opposing side plates 2, the packaging container 1 that has been folded does not open out again by itself and maintains its folded state. The thus folded packaging container 1 with its compact form maintained is suitable for being recycled or disposed as waste, for example.

Note that, although the packaging container 1 has been held with both of the insertion pieces 4*a* and 6*a* in the above description, a folded form of the packaging container 1 is not limited to this. For simplification of a folding process, the packaging container 1 can be held only with one of the insertion pieces 4*a* and 6*a*, e.g. only with the insertion piece 4*a*.

In this case, the top cover forming flap 6 that is not used for insertion can be folded inward as all other flaps, i.e. the second bottom plate forming flap 4, the first bottom plate forming flaps 5, the second top cover forming flap 6, and the first top cover forming flaps 7, so as to overlap the second opposing side plates 2 and the first opposing side plates 3 connected thereto. Conversely, no problem would occur when the packaging container 1 is held only by using the insertion piece 6*a*. That is, the packaging container 1 can be held when an insertion piece that is provided to at least one flap selected arbitrarily from among the second top cover forming flaps 6 and the second bottom plate forming flaps 4 is inserted inside the packaging container 1.

Second Embodiment

The following will describe another embodiment of the present invention with reference to FIGS. 9 through 16. Note that, the configuration except for the description in the present embodiment is the same as that described in the First Embodiment. For the purpose of explanation, members having the same functions as those described in the drawings of the First Embodiment are given the same reference numerals and detailed explanations thereof are omitted here.

Figure 9:
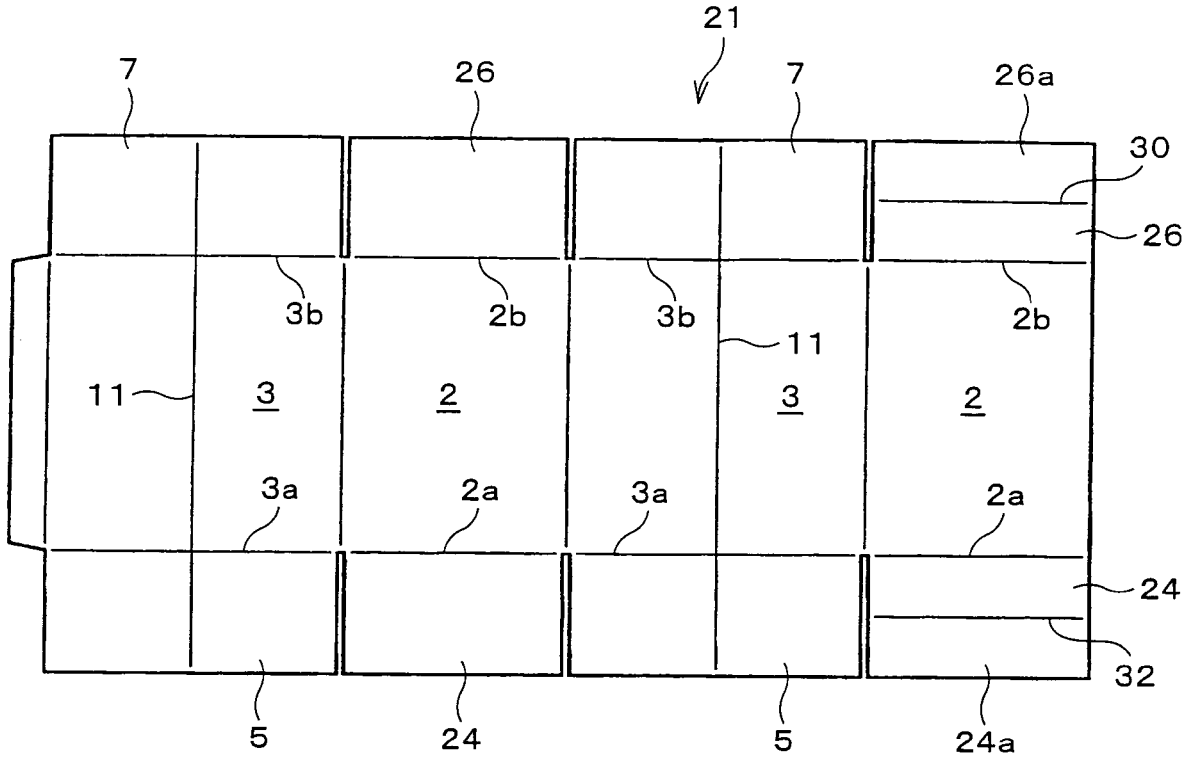
FIG. 9 is a developed view showing a packaging container of another embodiment of the present invention.

A packaging container 21 of the present embodiment, as shown in FIG. 9, is different from the packaging container 1 of the First Embodiment in that second top cover forming flaps 26 and second bottom plate forming flaps 24 each of which is respectively connected to a second opposing side plate 2 have a rectangular shape, only the second top cover forming flap 26 and the second bottom plate forming flap 24 which are provided to one of the second opposing side plates 2 are provided with fold sections 30 and 32, respectively, and slits 7*a* are not provided.

Specifically, in the packaging container 21 of the present embodiment, as shown in FIG. 9, one of the second bottom plate forming flaps 24 connected to the respective lower ends 2*a* of the second opposing side plates 2 having shorter sides and the second top cover forming flap 26 connected to the upper end 2*b* of the second opposing side plate 2 that is connected to the one of the bottom plate forming flaps 24 are provided with fold sections 32 and 30, respectively, so as to be parallel to the lower end 2*a* and the upper end 2*b* that are connection lines to the second opposing side plate 2. Also, leading end parts ahead of the fold sections 32 and 30 are adapted to be available as the insertion pieces 24*a* and 26*a* when the packaging container 1 is disposed as waste and recycled. Note that, the fold sections 32 and 30 may be formed as typical rules line. They may be also formed in a perforated or serrated manner, and any type of form may be adopted as long as it is foldable therealong.

The following will describe a process for folding up the packaging container 21 in the above arrangement.

Figure 10:
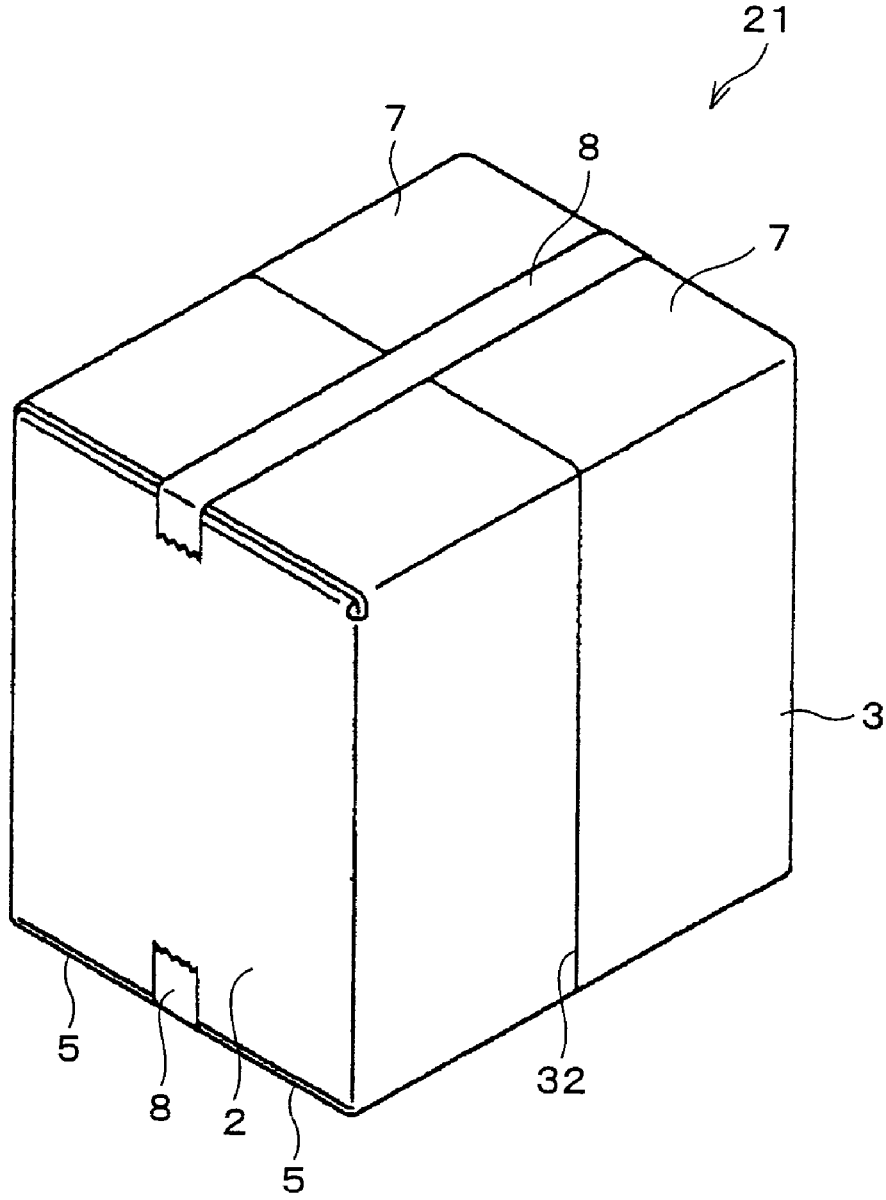
FIG. 10 is a perspective view showing a state of the packaging container when an article to be packaged is stored therein.
Figure 11:
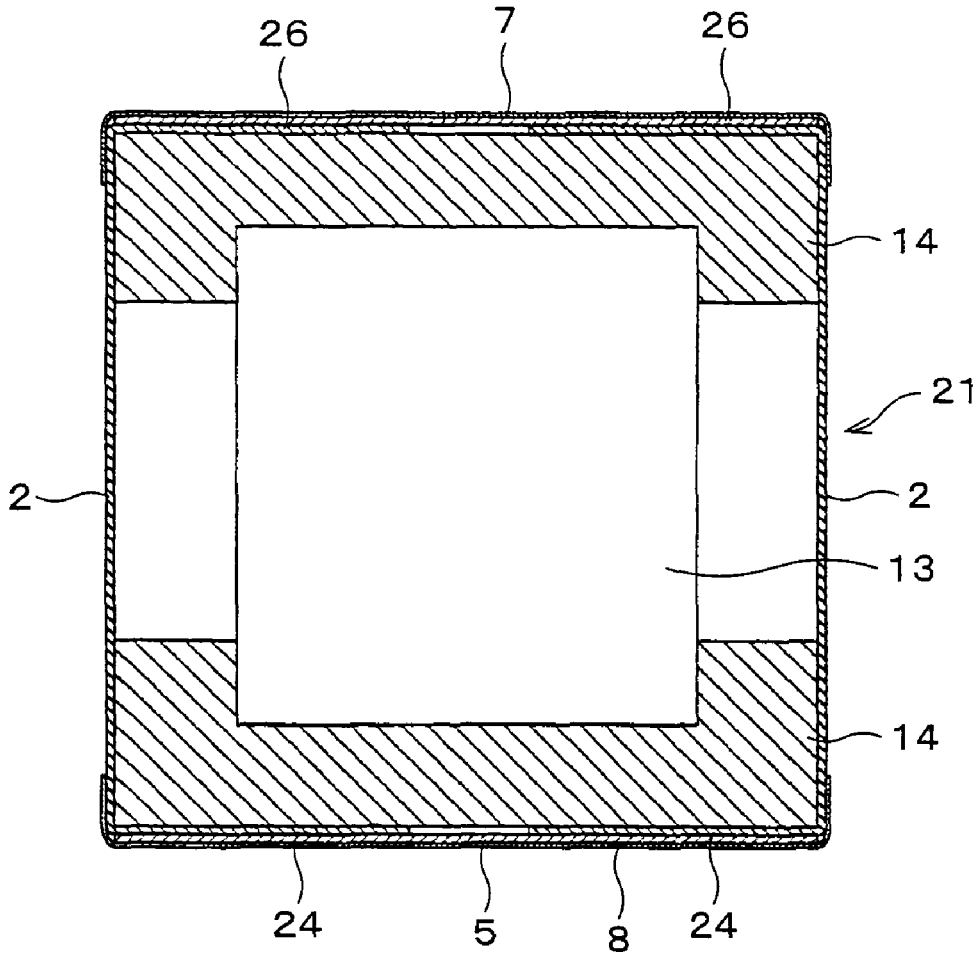
FIG. 11 is a cross-sectional view showing a state of the packaging container when an article to be packaged is stored therein.

As shown in FIGS. 10 and 11, a packaged article 13 protected by cushioning material 14, for example, is stored inside the assembled packaging container 21.

Figure 12:
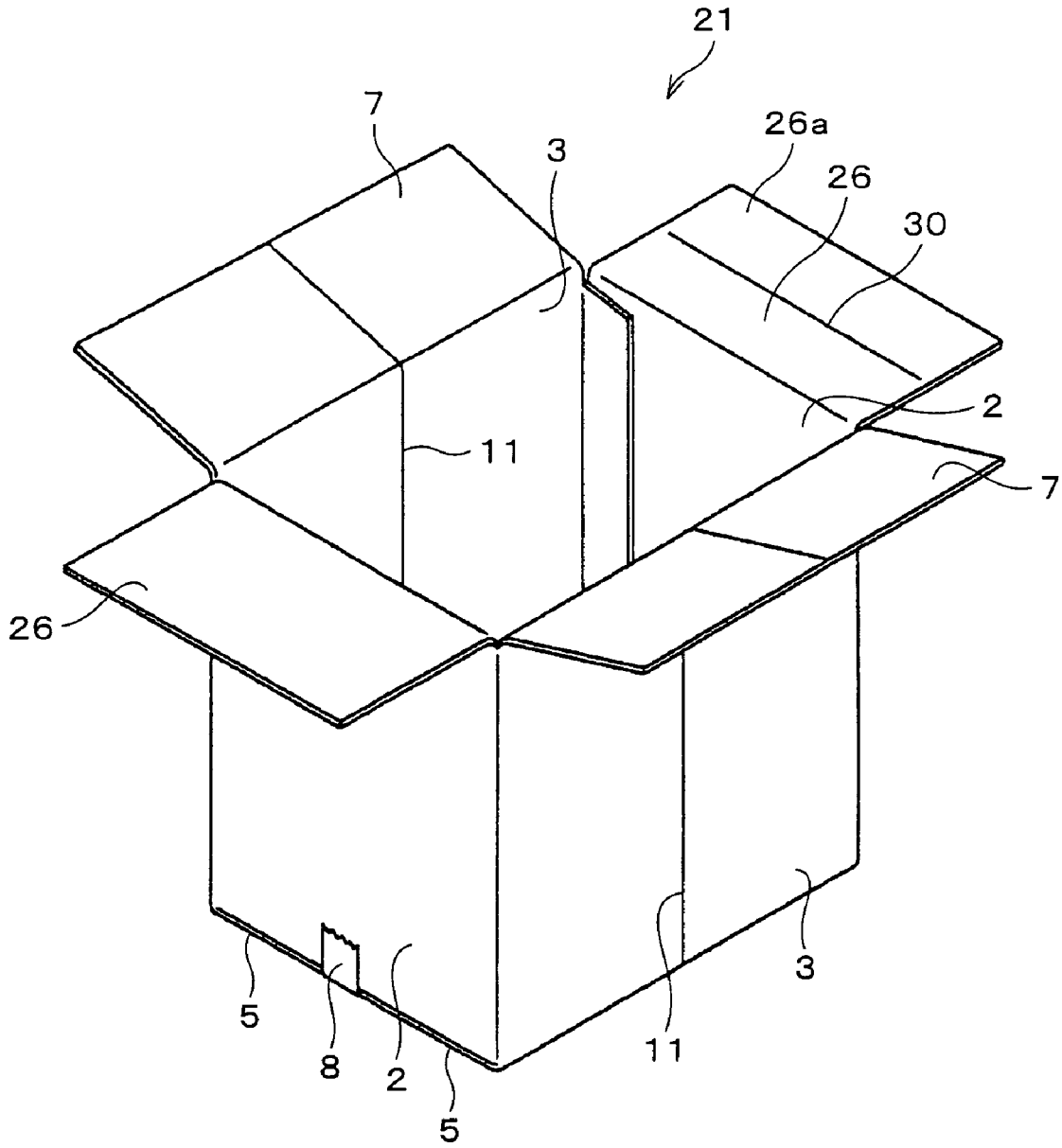
FIG. 12 is a perspective view showing a state of the packaging container after the article to be packaged is taken out of it.
Figure 13:
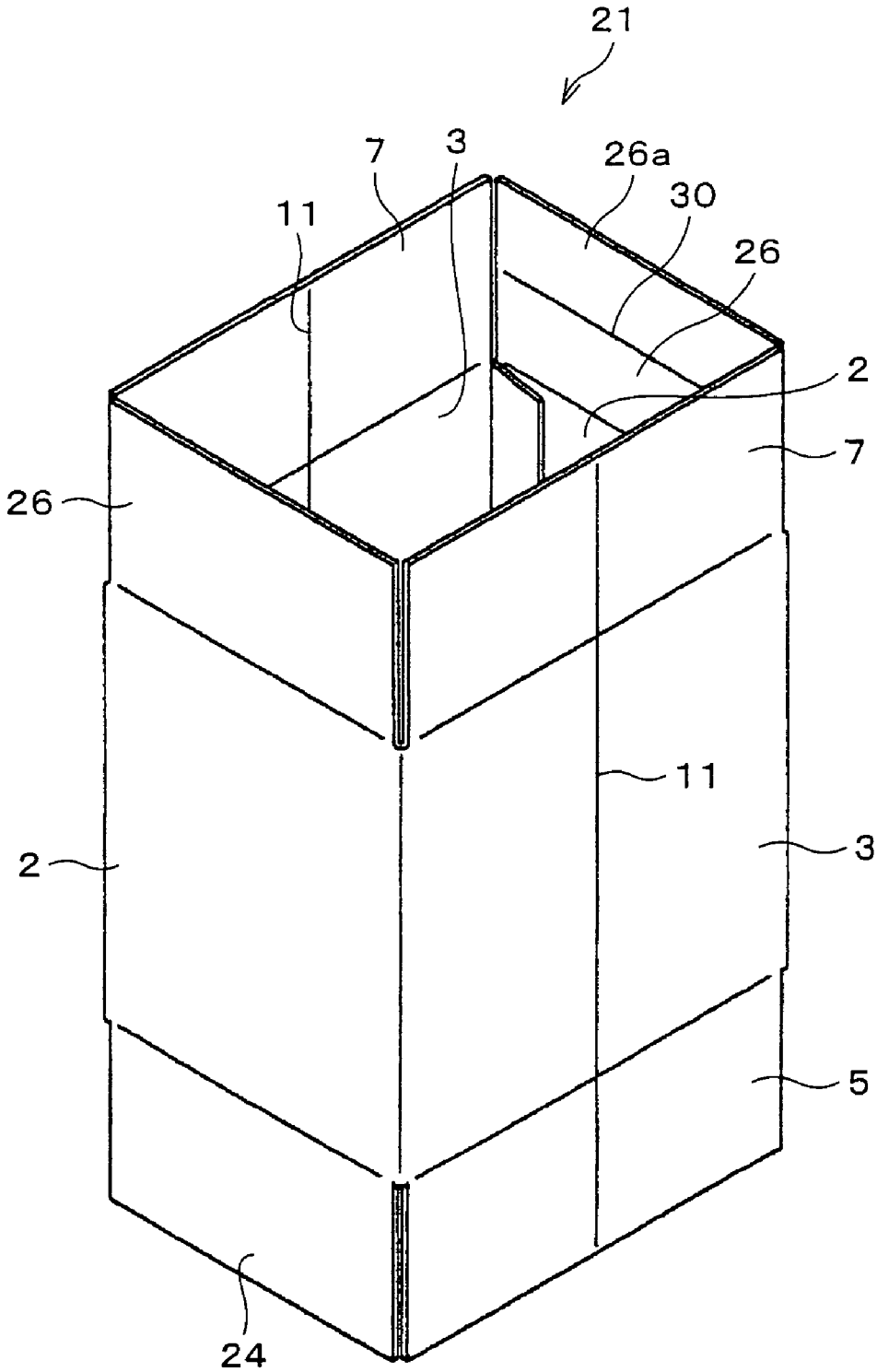
FIG. 13 is a perspective view showing a state of the packaging container standing in a cylindrical manner.

As shown in FIG. 12, the packaged article 13 and the cushioning material 14 are taken out of the packaging container 21 while the second top cover forming flaps 26 and first top cover forming flaps 7 are kept opened. Next, a sealing tape 8 is peeled away and, as shown in FIG. 13, the second bottom plate forming flaps 24, the first bottom plate forming flaps 5, and the top cover forming flaps 26, and the first top cover forming flaps 7 are opened to become flush with respect to the two pairs of opposing side plates 2 and 3, so as to make the packaging container 21 in a cylindrical manner.

Figure 14:
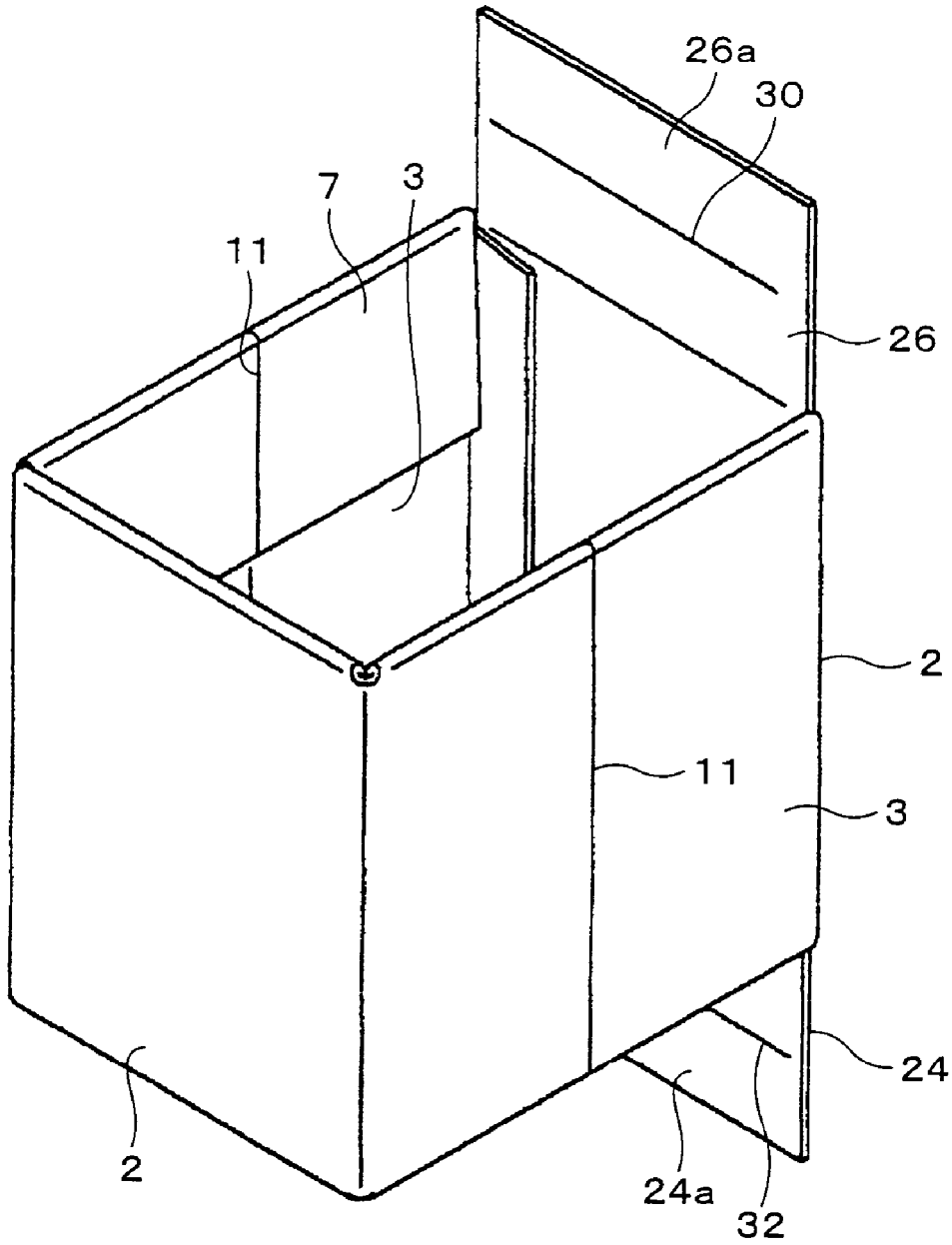
FIG. 14 is a perspective view showing a state of the packaging container in progress in folding up.

With this state, as shown in FIG. 14, while the second bottom plate forming flap 24 and the second top cover forming flap 26 which are respectively connected to the lower end 2*a* and the upper end 2*b* of one of the second opposing side plates 2 are left unfold, all of the other flaps, i.e. the other of the second bottom plate forming flaps 24, the first bottom plate forming flaps 5, the other of the second top cover forming flaps 26, and the first top cover forming flaps 7, are folded, for example, inwardly so as to overlap the other of the second opposing side plates 2 and the first opposing side plates 3, respectively, connected thereto.

Figure 15:
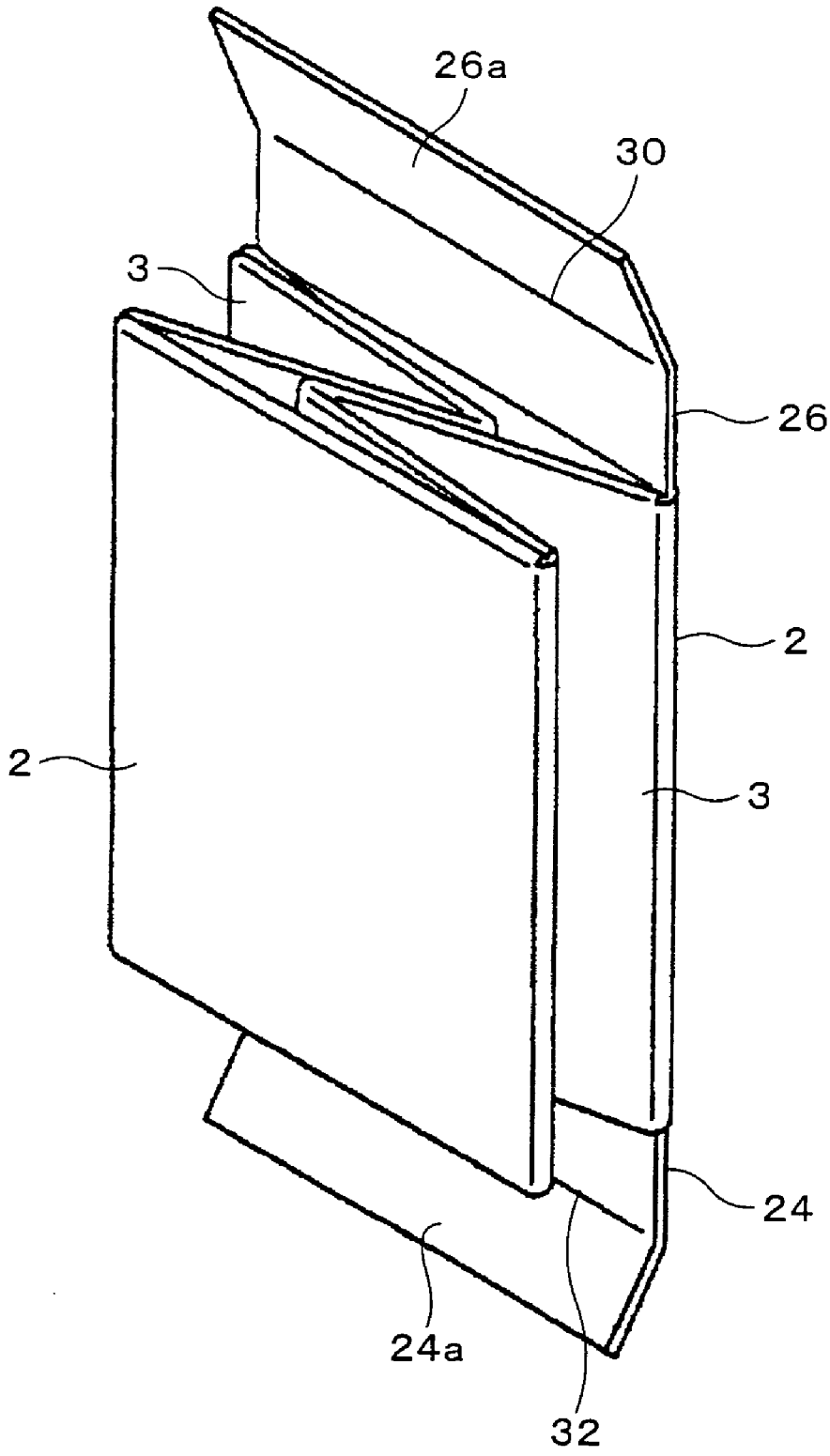
FIG. 15 is a perspective view showing a state of the packaging container folded up so that its opposing side plates are in the form of the letter V.

In such a state, as shown in FIG. 15, the opposing side plates 3, the first bottom plate forming flaps 5, and the first top cover forming flaps 7 are inwardly folded in the form of the letter V at the fold sections 11 inside the packaging container 21 so as to be sandwiched between the second opposing side plates 2.

Figure 16:
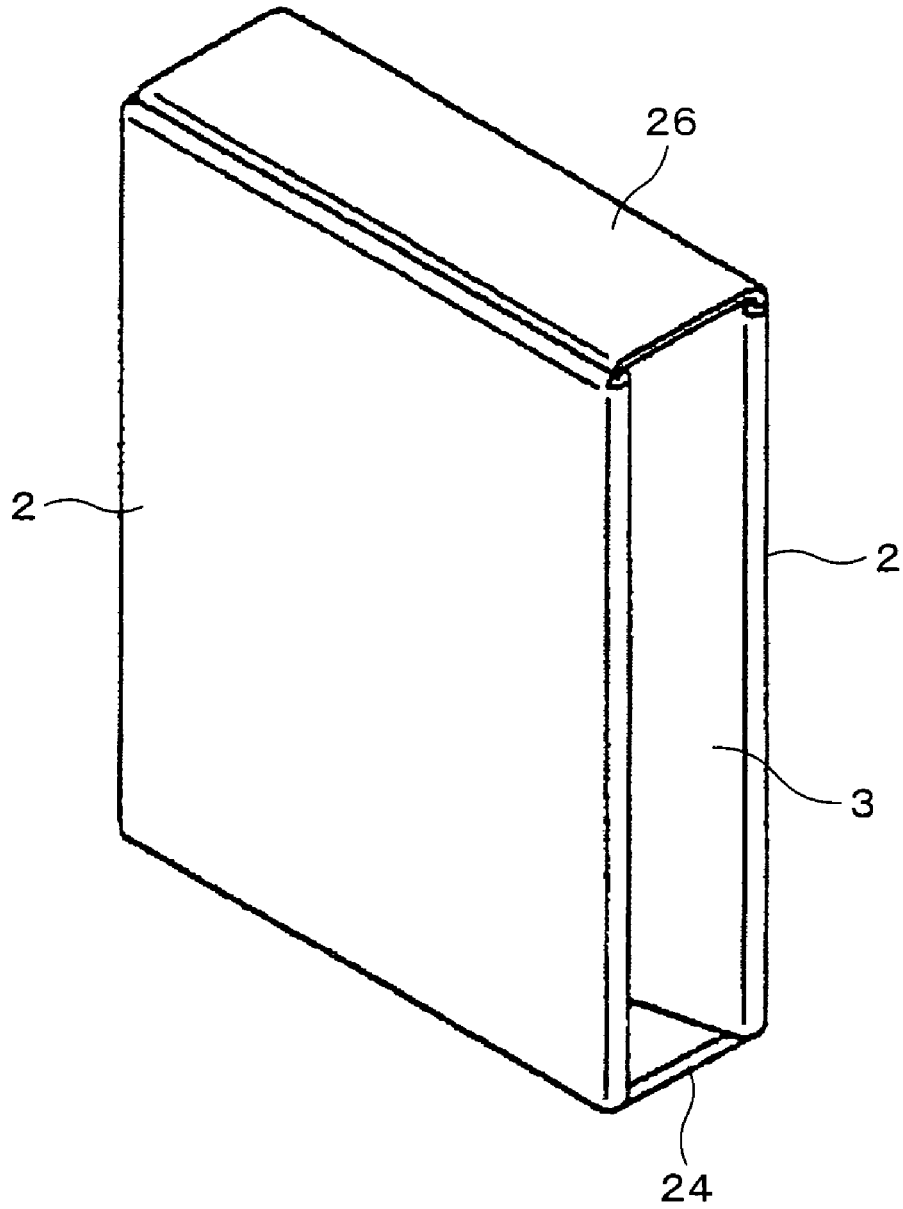
FIG. 16 is a perspective view showing a state of the packaging container folded up by inserting insertion pieces.
Figure 17A:
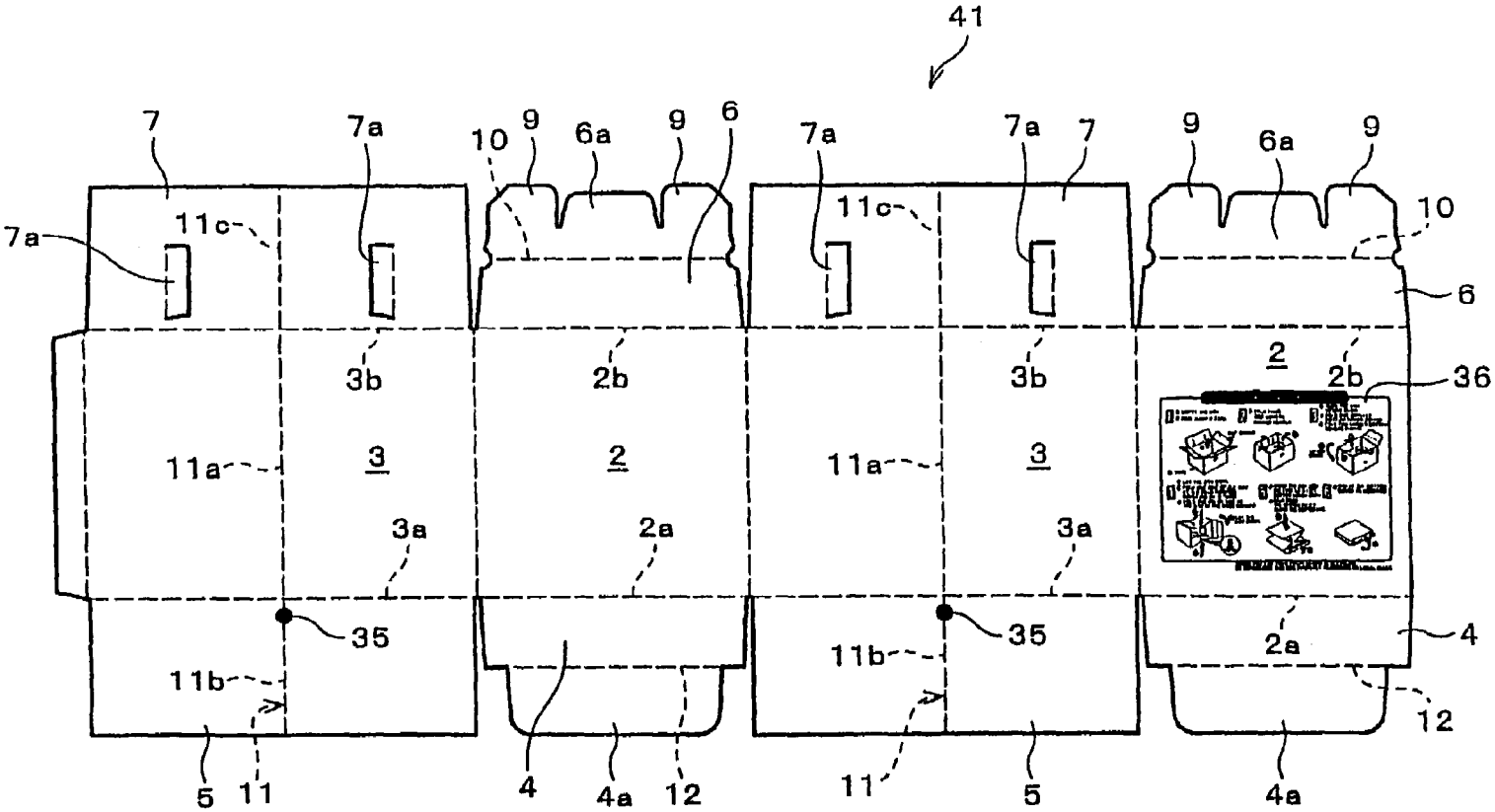
FIGS. 17A-17D are views showing a packaging container of still other embodiments of the present invention and developed views showing a packaging container wherein an explanatory drawing showing how to fold up the packaging container is printed onto one side plate.
Figure 17B:
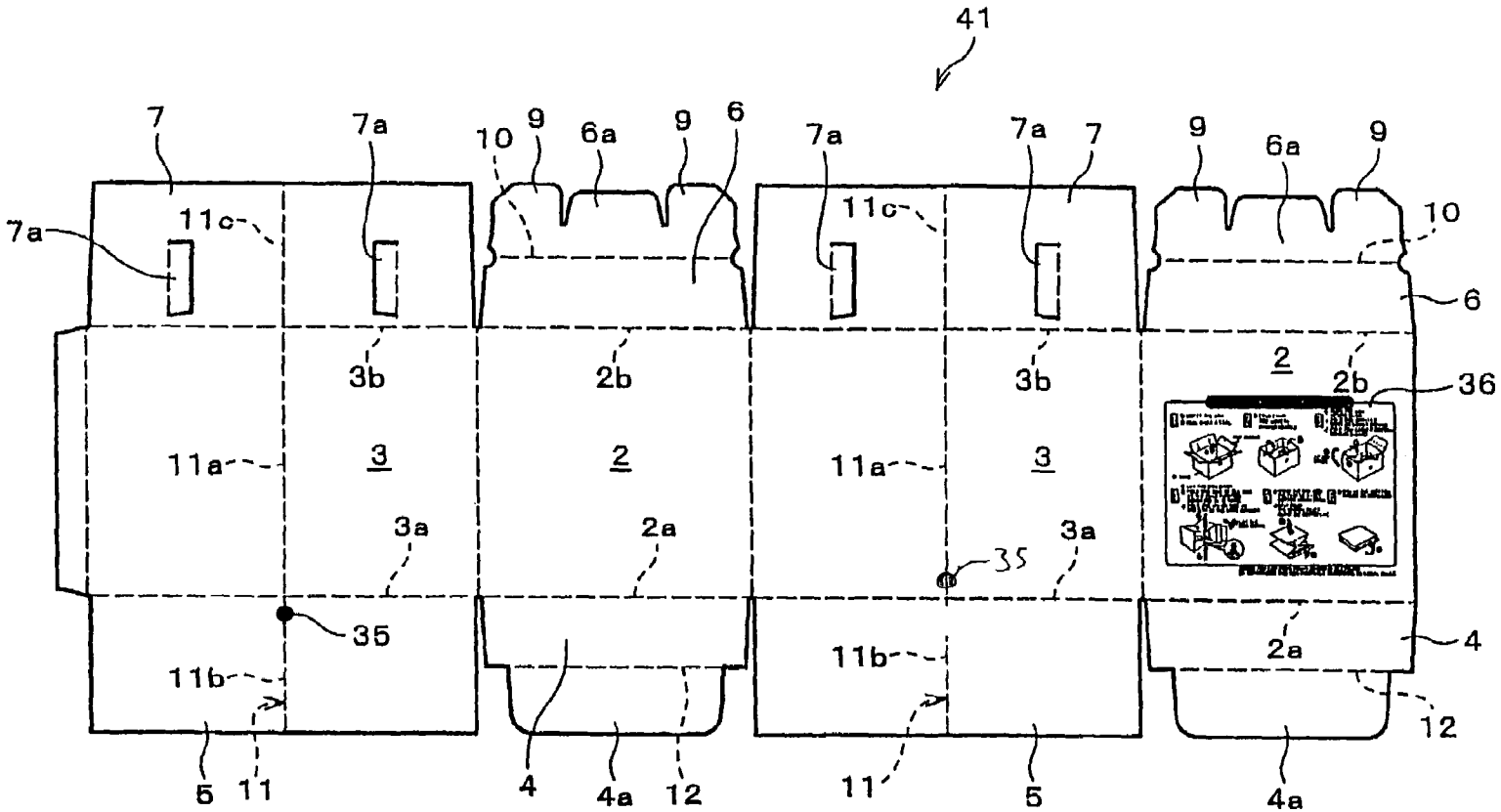
Figure 17C:
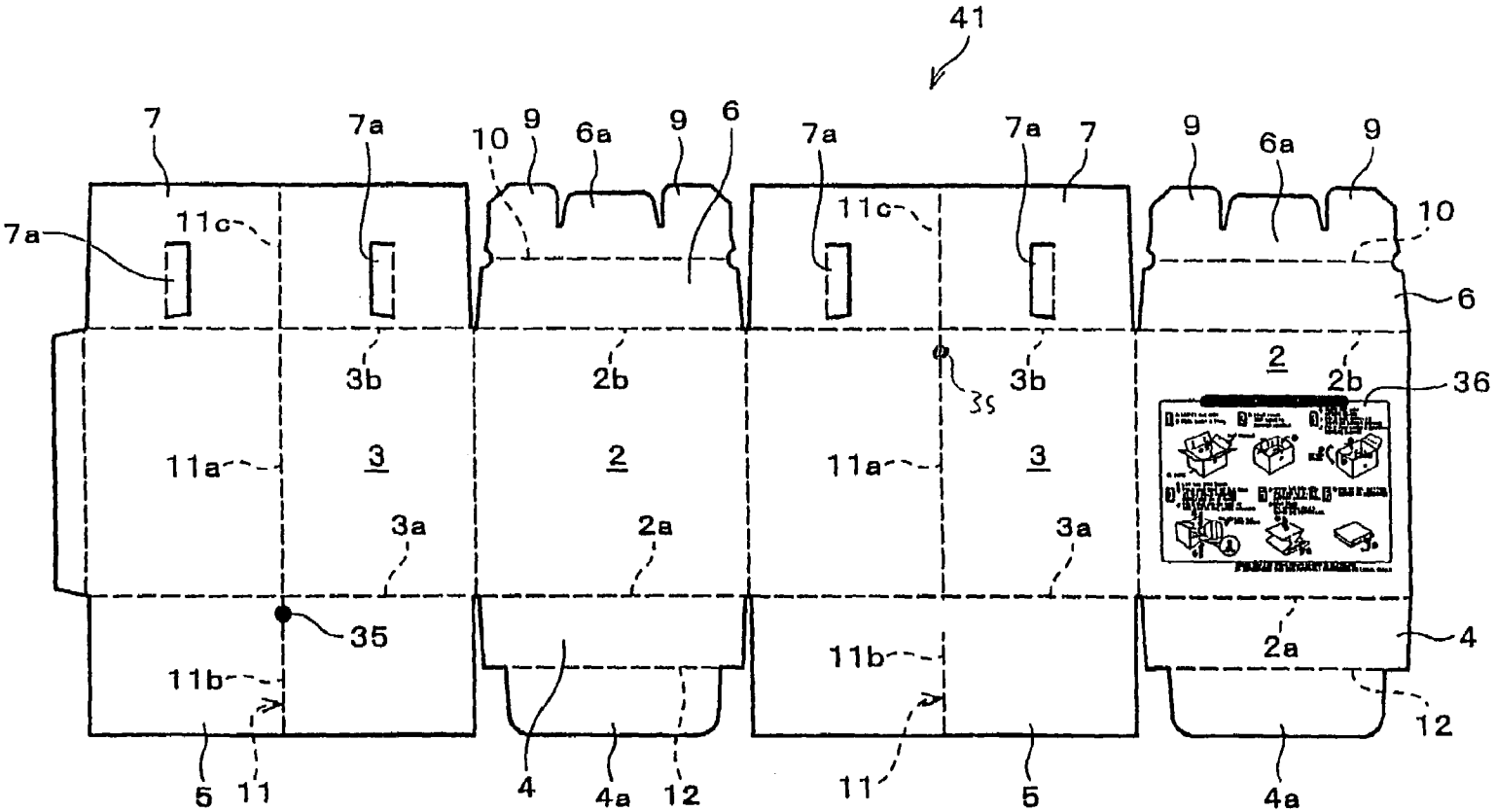
Figure 17D:
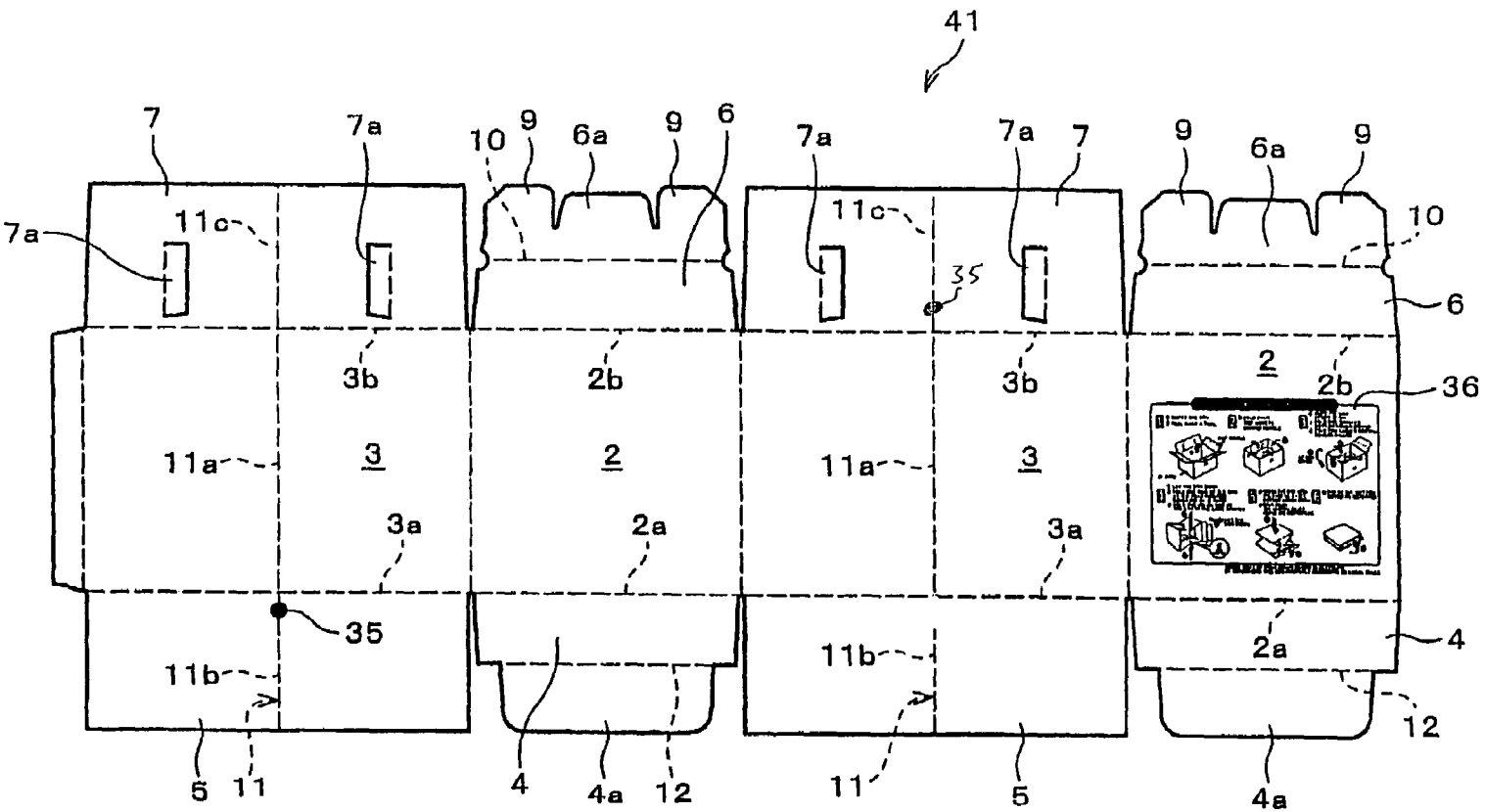

Next, the insertion piece 24*a* is formed by folding along the fold section 32 that is provided on the one of the second bottom plate forming flaps 24, and the insertion piece 26*a* is formed by folding along the fold section 30 that is provided on the one of the second top cover forming flaps 26. The insertion pieces 24*a* and 26*a*, as shown in FIG. 16, are inserted inside the other of the second opposing side plates 2. More specifically, the insertion pieces 24*a* and 26*a* are inserted so as to respectively overlap the other of the second bottom plate forming flaps 24 and the other of the second top cover forming flaps 26 that have been folded so as to overlap the inner surface of the other of the opposing side plates 2.

This brings the packaging container 21 in a compactly folded state. Since the insertion pieces 24*a* and 26*a* of the one of the second opposing side plates 2 are inserted inside the other of the second opposing side plates 2, the packaging container 21 that has been folded does not open out again by itself and maintains its folded state. The thus folded packaging container 21 with its compact form maintained is suitable for being recycled or disposed as waste, for example.

Note that, for simplification of a folding process, it is also possible to hold the packaging container 1 only with one of the insertion pieces 24*a* and 26*a*.

Thus, although the fold section 12 is also provided on the other of the second bottom plate forming flaps 4 in the packaging container 1 of the First Embodiment, the fold section 12 does not specially need to be provided on the other of the second bottom plate forming flaps as described in the present embodiment. However, it is not necessarily limited to this arrangement. The fold sections 32 and 30 may be provided respectively on the other of the second bottom plate forming flaps 24 and the other of the second top cover forming flaps 26, in the same manner as the one of the second bottom plate forming flaps 24 and the one of the second top cover forming flaps 26.

Further, the first opposing side plate 3 having longer sides, the first bottom plate forming flap 5 connected to the lower end 3*a* of the first opposing side plate 3, and the first top cover forming flap 7 connected to the upper end 3*b* of the first opposing side plate 3 are provided with one continuous fold section 11 thereacross centrally in the width direction of the first opposing side plate 3. However, it is not necessarily limited to this arrangement. For example, the second opposing side plate 2 having shorter sides, the second bottom plate forming flap 4 or 24 connected to the lower end 2*a* of the second opposing side plate 2, and the second top cover forming flap 6 or 26 connected to the upper end 2*b* of the opposing side plate 2 may be provided with one continuous fold section thereacross centrally in the width direction of the second opposing side plate 2. That is, an opposing side plate where the fold section 11 is provided is not limited to the opposing side plate having shorter sides. In addition, it is sufficient that the fold section 11 is provided in a substantially central part in the width direction of the opposing side plate.

Third Embodiment

The following will describe still another embodiment of the present invention with reference to FIGS. 17 though 29. Note that, the configuration except for the description in the present embodiment is the same as those described in the First Embodiment and the second Embodiment. For the purpose of explanation, members having the same functions as those described in the drawings of the First Embodiment and the Second Embodiment are given the same reference numerals and detailed explanations thereof are omitted here.

Figure 18:
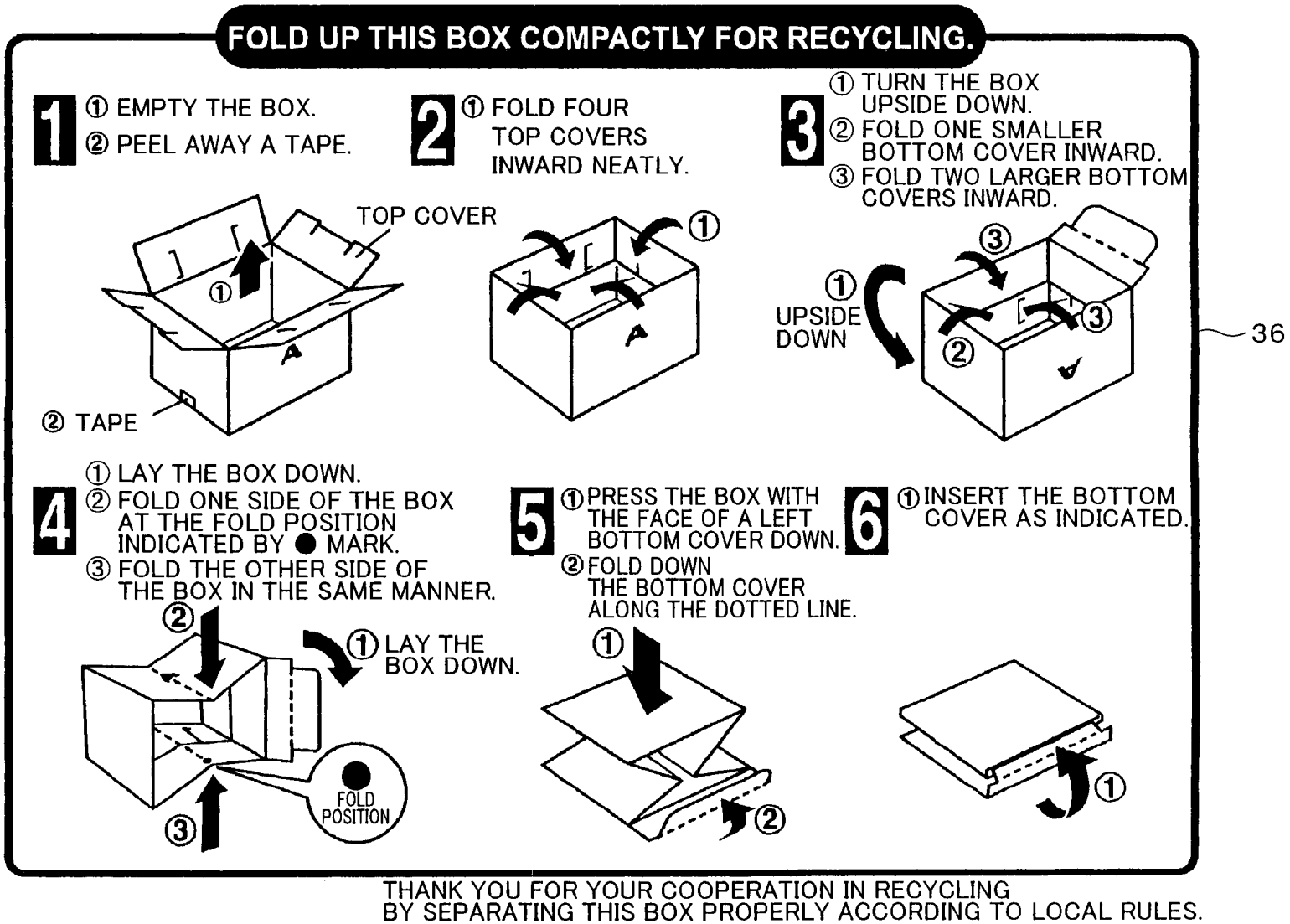
FIG. 18 is a front view showing an explanatory drawing for explaining how to fold up the packaging container.

A packaging container 41 of the present embodiment, as shown in FIG. 17, is totally different from the packaging container 1 of the First Embodiment in that the second opposing side plate 2 is provided with an explanatory drawing 36 as an explanation section for explaining how to fold up this packaging container 41, as shown in FIG. 18.

In the packaging container 41 of the present embodiment, it is possible to carry out a folding operation while referring to the explanatory drawing 36 until folding of the packaging container 41 is completed, ensuring the packaging container 41 to be folded up. Note that, it is preferable that the explanatory drawing 36 is provided on both of the second opposing side plates 2 because the explanatory drawings 36 could be referred to from any directions in folding up the packaging container 41. However, the explanatory drawing 36 can be provided on at least one of the second opposing side plates 2. Moreover, the most preferable method for providing the explanatory drawing 36, but is not especially limited, is printing because printing is a simple and easy method and allows cost reduction.

Figure 19:
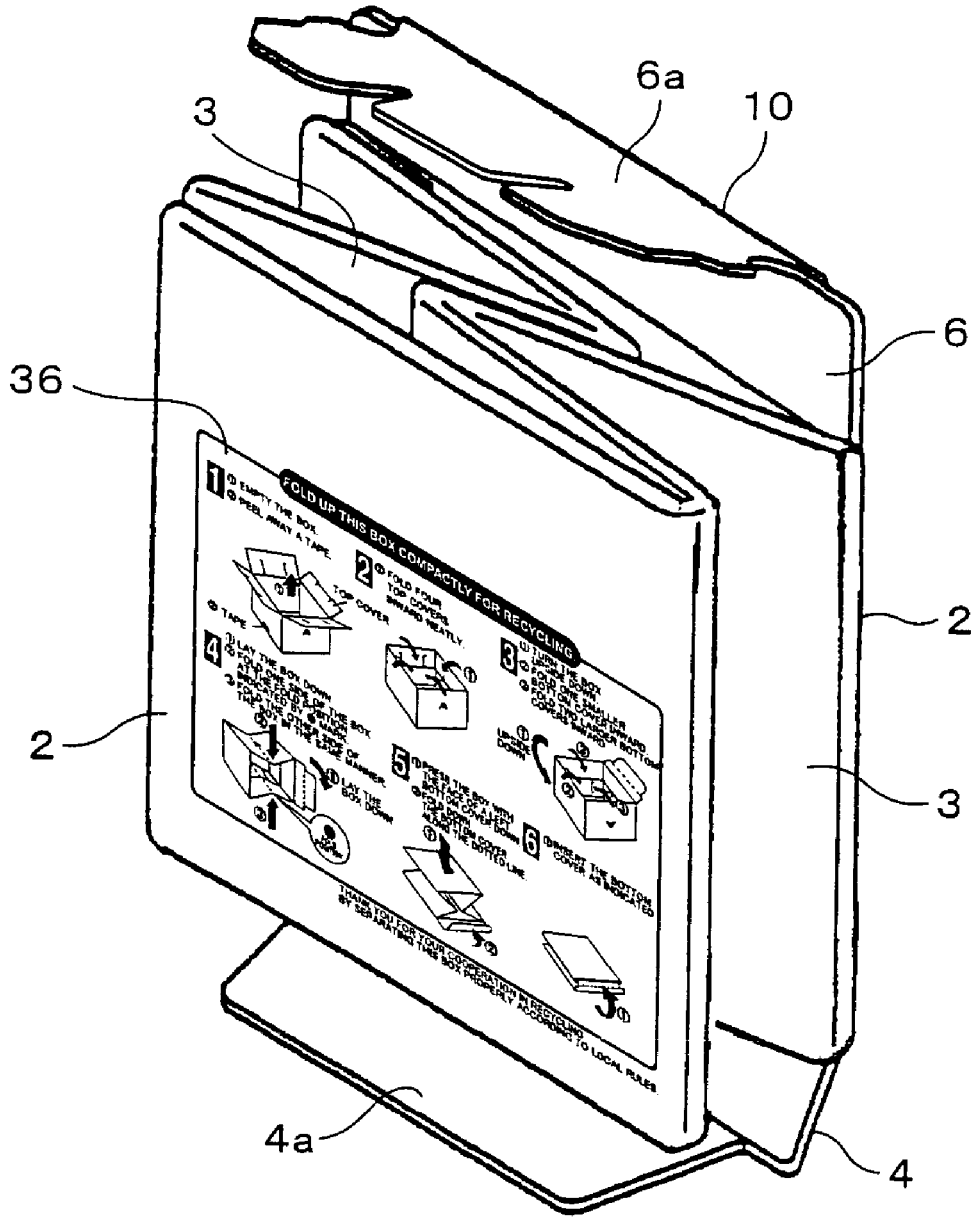
FIG. 19 is a perspective view showing a state of the folded packaging container with the explanatory drawing.
Figure 20:
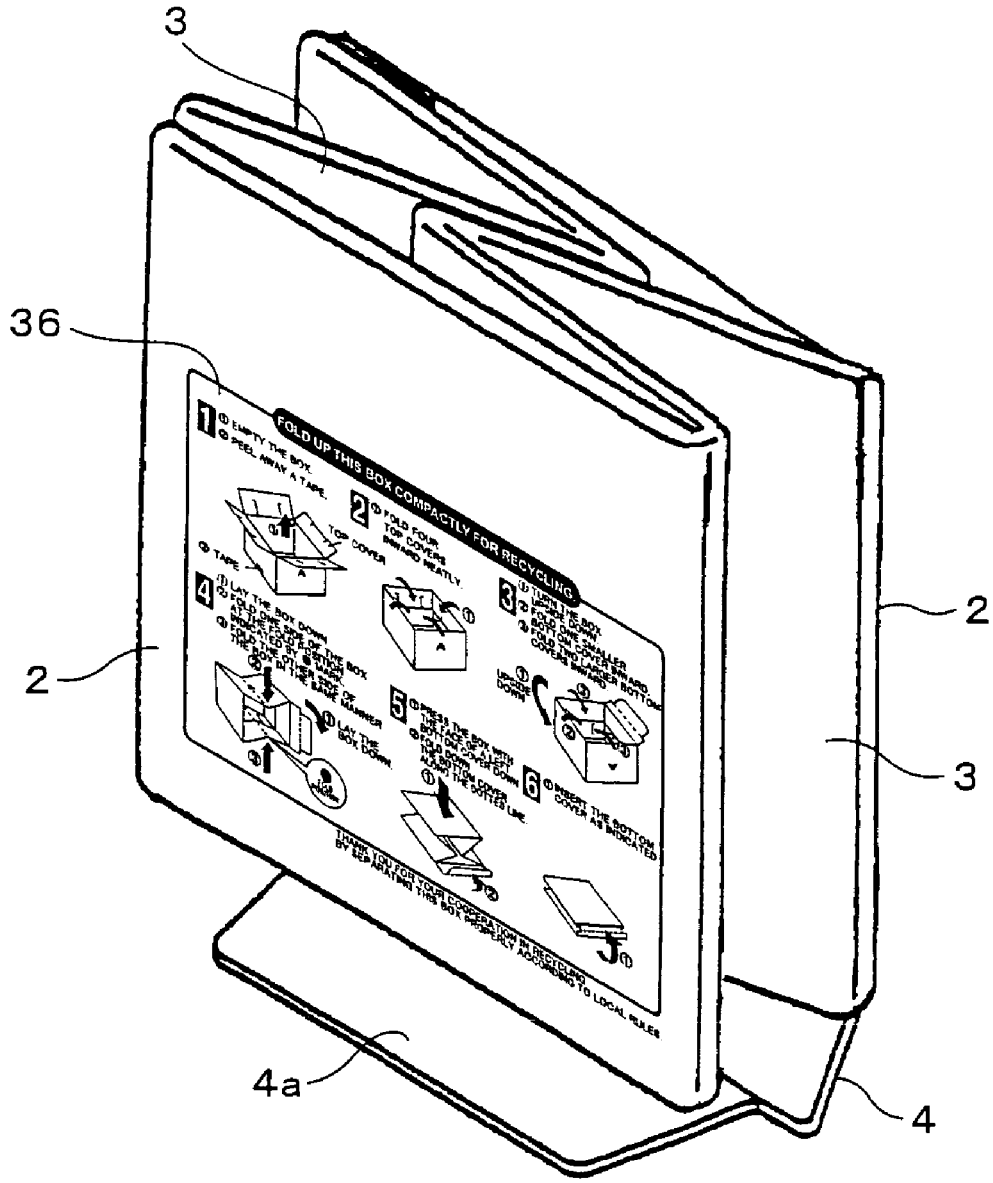
FIG. 20 is a perspective view showing another state of the folded packaging container with the explanatory drawing.

In the present embodiment, the explanatory drawing 36 is provided on the second opposing side plate 2. Therefore, in operating Steps 1 through 4 among Steps 1 though 6 for a folding procedure shown in FIG. 18, even after the first opposing side plates 3 are folded inward along the respective fold sections 11, which are provided substantially in the central part of the first opposing side plates 3, according to the Step 4, as shown in FIGS. 19 and 20, the explanatory drawing 36 without being disappeared can be referred to until operation of the step 6 is completed.

Further, in the packaging container 41 of the present embodiment, as shown in FIGS. 17A-17D, the first bottom plate forming flaps 5 are respectively provided with fold position marks 35 as a mark section for use in explanation of how to fold up the packaging container 41, in the vicinity of leaders of the second fold sections 11*b*, i.e. in the vicinity of the lower ends 3*a* of the first bottom plate forming flaps 5. Providing the fold position marks 35 facilitates checking of the positions indicating the fold sections 11.

Note that, the fold position marks 35 may be provided respectively in the vicinity of leaders of third fold sections

11*c* provided on first top cover forming flaps 7 or may be provided respectively in the vicinity of leaders of first fold sections 11*a* provided on the first opposing side plates 3. In addition, the fold position marks 35 may be provided in the vicinity of all leaders of the first fold sections 11*a*, the second fold sections 11*b*, and the third fold sections 11*c*. That is, the fold position marks 35 may be provided in the vicinity of leaders of at least one of the first fold sections 11*a*, the second fold sections 11*b*, and the third fold sections 11*c* (see FIGS. 17B-17D).

Figure 21:
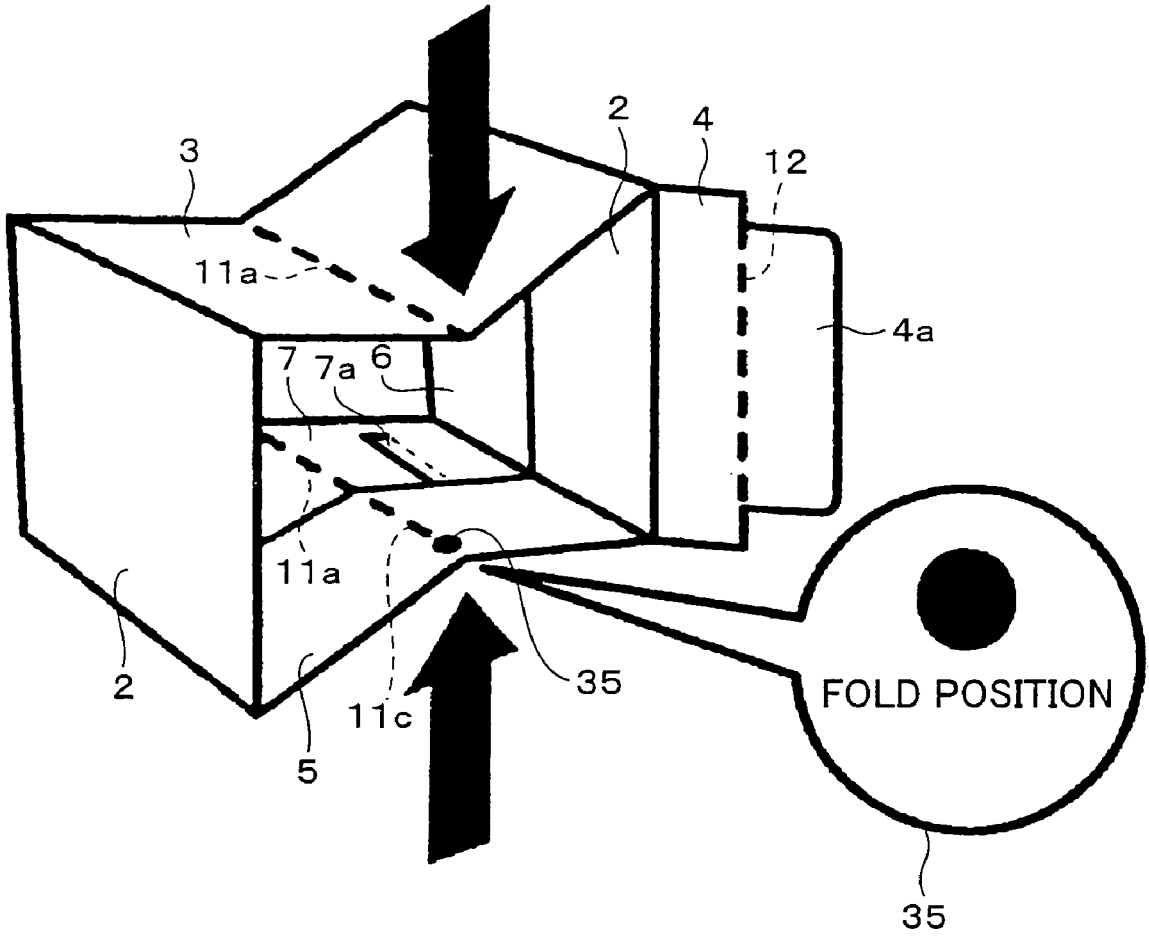
FIG. 21 a perspective view explaining how to hold up the packaging container with a fold position mark.

Further, shape, color, and provision means of the fold position mark 35 are not especially limited, so long as it can facilitate checking a position for folding up the packaging container 41. For example, the fold position mark 35 is a circle filled in with black, as shown in FIG. 21, However, shape of the fold position mark 35 is not limited to this, and it may be a shape such as triangle, square, rhombus, or star shape. In addition, color for filling in the fold position mark 35 is not limited to black. It may be any color, and it does not matter whether the fold position mark 35 is filled in or not. In providing the fold position mark 35, printing is, but not limited to, the most preferable method because printing is a simple and easy method and allows cost reduction. For example, the fold position mark 35 can be provided with a perforated shape.

Figure 22:
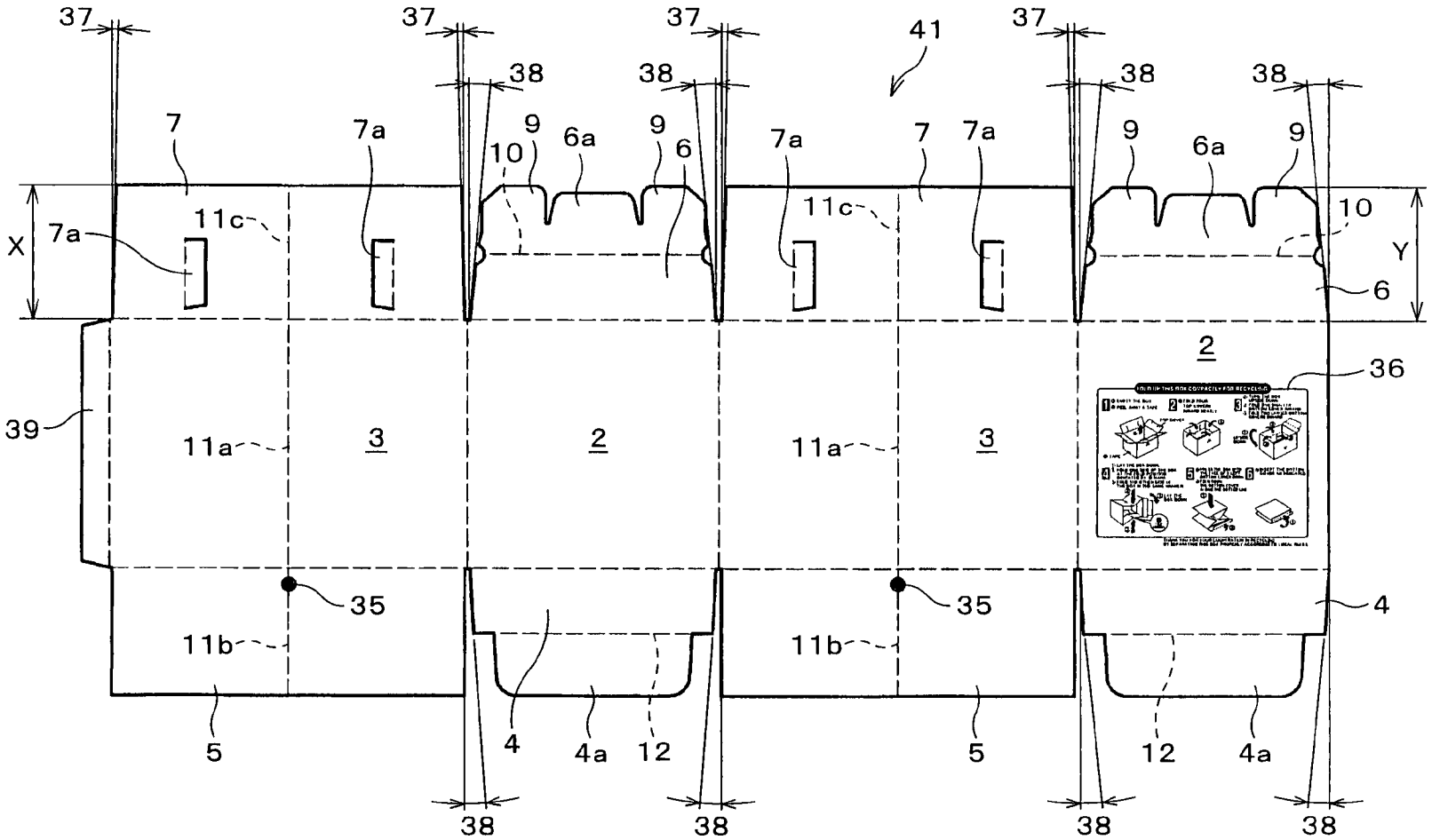
FIG. 22 is a developed view showing the packaging container wherein the respective lengths of first top cover forming flaps are substantially the same as those of second top cover forming flaps, and the first and second top cover forming flaps are provided respective slants so that widths of the first and second top cover forming flaps decrease with increase in lengths of the first and second top cover forming flaps.
Figure 23:
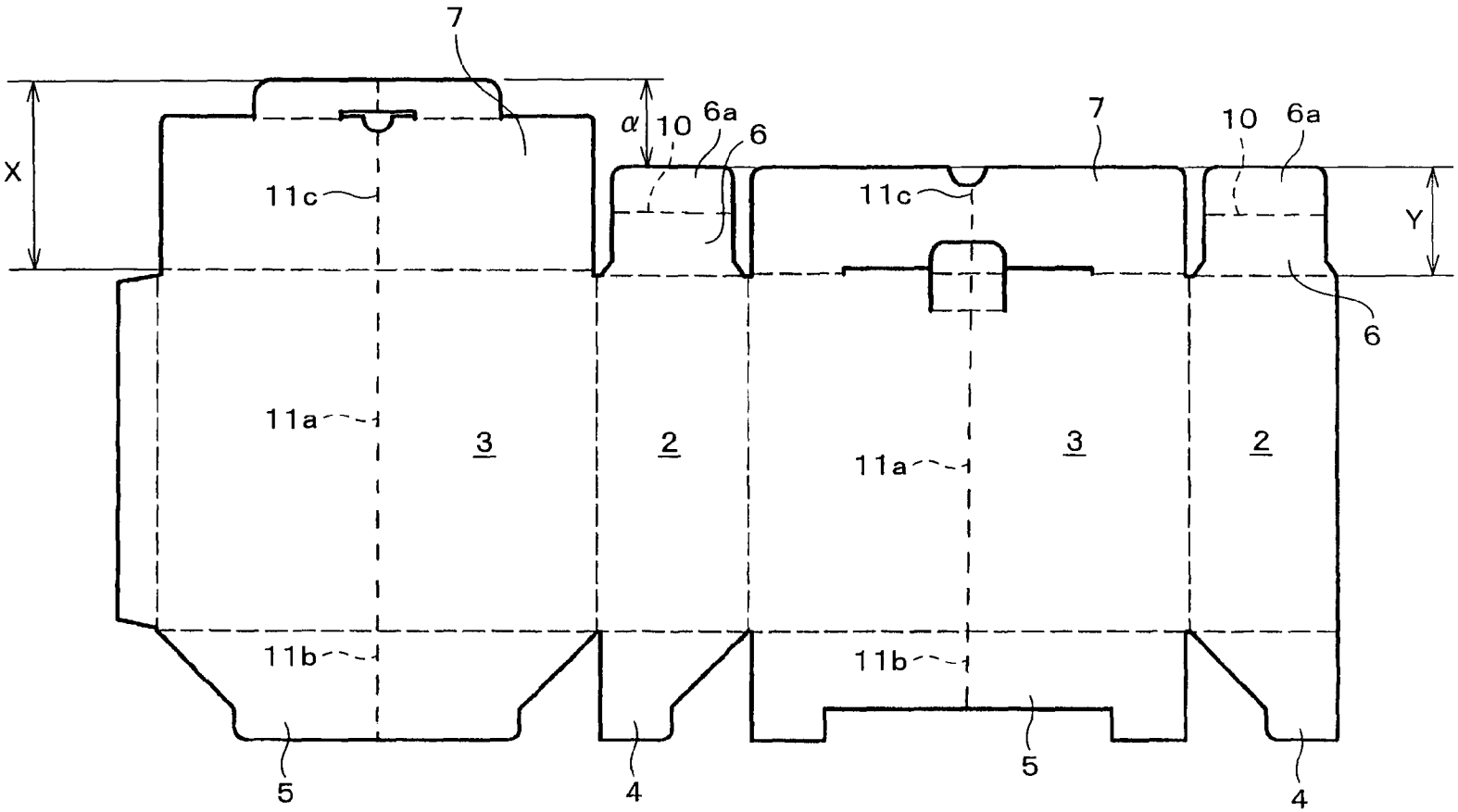
FIG. 23 is a developed view showing a packaging container wherein the respective lengths of first top cover forming flaps are different from those of second top cover forming flaps.

Further, in the packaging container 41 of the present embodiment, as shown in FIG. 22, the respective lengths X of the first top cover forming flaps 7 each of which extends from the end part of the first opposing side plate 3 are substantially the same as the respective lengths Y of the second top cover forming flaps 6 each of which extends from the end part of the second opposing side plate 2. This arrangement enables reduction of a paper excess part α which is difference between the length X of the first top cover forming flap 7 and the length Y of the second top cover forming flap 6, caused in a box form as shown in FIG. 23. Note that, in the present embodiment, the length of the two insertion pieces 6*a* is also substantially the same as the length Y of the second top cover forming flap 6.

Figure 24:
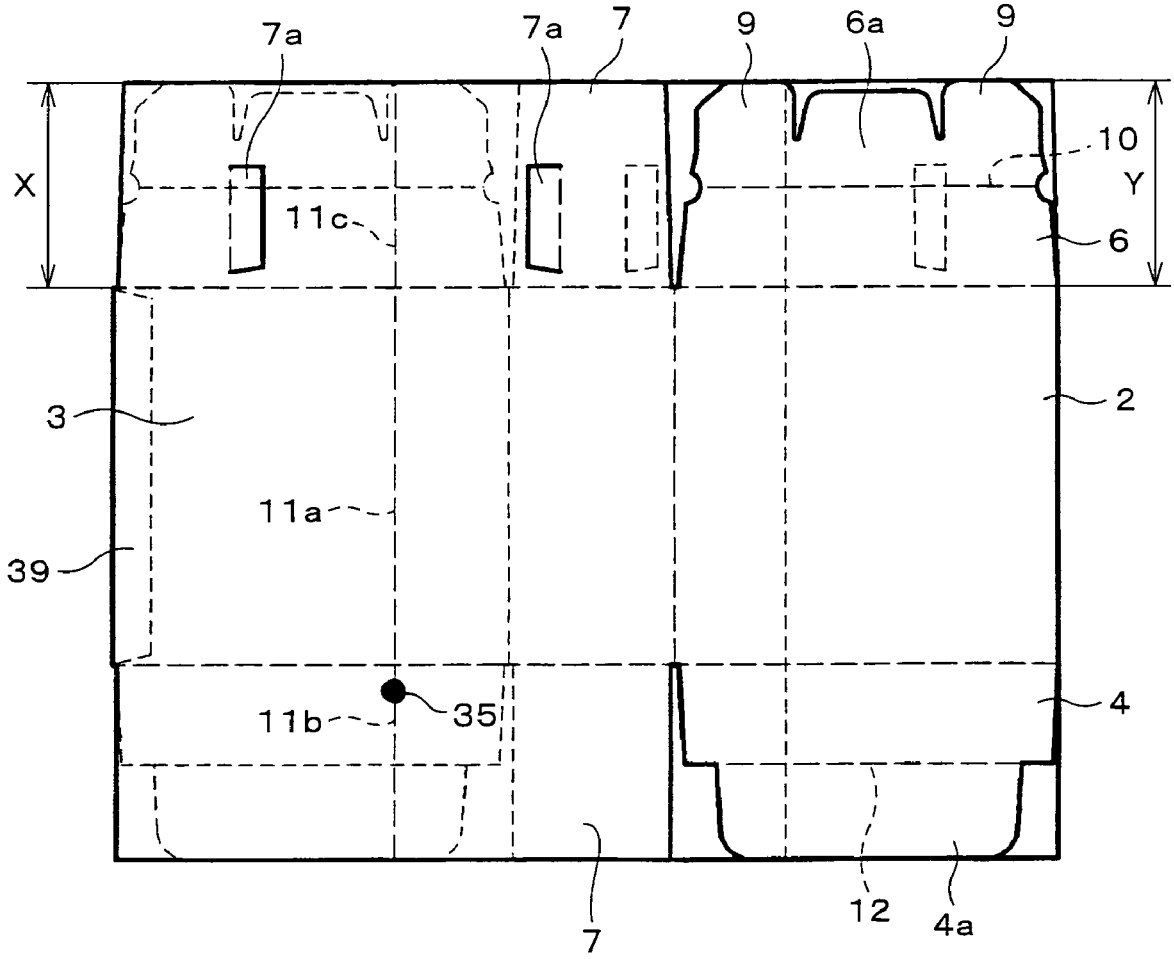
FIG. 24 is a plan view showing a delivered form of the packaging container shown in FIG. 22.

Moreover, as shown in FIG. 24, the length X is substantially the same as the length Y. Unlike the arrangement in FIG. 23, this arrangement causes no breaks in the paper excess part α of the top cover forming flap, which is a projected extension piece, during the course of distribution for the packaging container 41. This allows stability in quality of the packaging container 41.

Further, in the present embodiment, the first top cover forming flap 7 and the second top cover forming flap 6 are provided with slants 37 and 38, respectively, so that the widths of the first top cover forming flap 7 and the second top cover forming flap 6 decrease with increase in the lengths X and Y.

Figure 25:
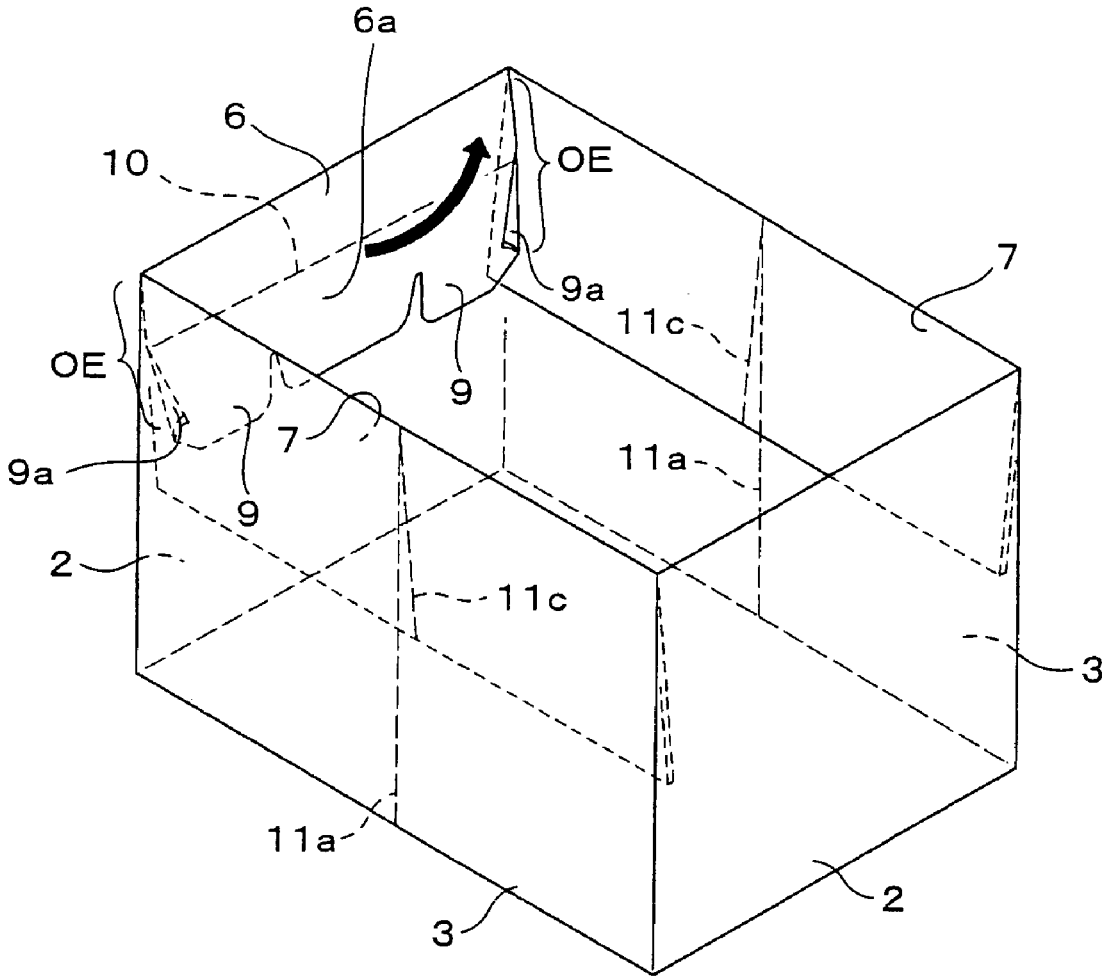
FIG. 25 is a perspective view showing a problem occurring during a step of folding a top cover forming flap without slants.

In the case where the slants 37 and 38 are not provided respectively to the first top cover forming flap 7 and the second the top cover forming flap 6, the following problem would be caused in folding the first top cover forming flaps 7 and the second top cover forming flaps 6 as shown in FIG. 25.

That is, in the case where the first top cover forming flap 7 and the second top cover forming flap 6 without providing the respective slants 37 and 38 are folded until they contact the respective inner surfaces of the opposing side plate 2 and the opposing side plate 3, curls 9*a* occur in the outer edge parts OE of the second top cover forming flap 6 due to loads caused by thickness of the first top cover forming flap 7 and reaction of the first top cover forming flap 7 when the first top cover forming flap 7 are folded inwardly. This causes a tendency that the second top cover forming flaps 6 move away in the outward direction indicated by an arrow (a thick arrow in FIG. 25), which could make it difficult to carry out inwardly folding operation of the second top cover forming flaps 6.

In order to solve the problem, as shown in FIG. 22, the first top cover forming flap 7 and the second top cover forming flap 6 are provided with the slants 37 and 38, respectively. With this arrangement, when the first top cover forming flaps 7 and the second top cover forming flaps 6 are folded inward until they contact the respective inner surfaces of the opposing side plates 2 and the opposing side plates 3, the outer edge parts OE of the second top cover forming flaps 6 resist rebound of the first top cover forming flaps 7. This facilitates folding of these flaps.

That is, by providing the slants 38 to the second top cover forming flap 6, the outer edge parts OE of the second top cover forming flaps 6 can resist the first top cover forming flaps 7 regardless of a folding order. This results in facilitating inwardly folding and holding the packaging container 41.

Incidentally, as the first top cover forming flaps 7 and the second top cover forming flaps 6, the first bottom plate forming flaps 5 and the second bottom plate forming flaps 4 can be respectively provided with the slants 37 and 38 for folding. However, in the case where the slants increase with increase in length of the first bottom plate forming flaps 5, the problem of a large misalignment as indicated by an arrow C occurs in forming a bottom plate, as shown in FIG. 28(*a*).

Figure 29:
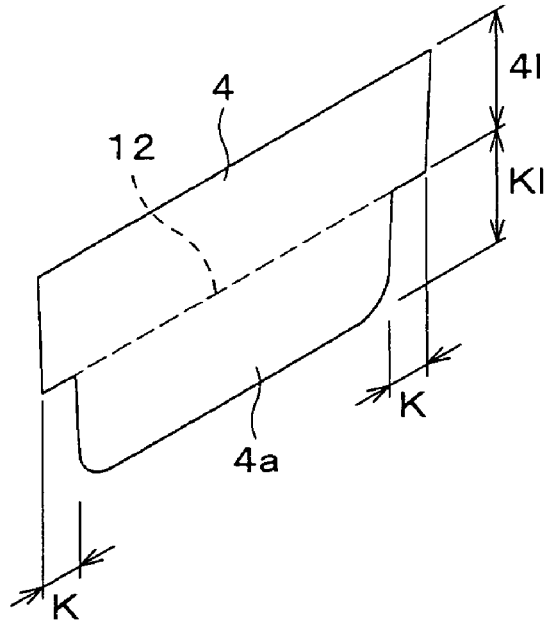
FIG. 29(*a*) is an enlarged view of a relevant part of a top cover forming flap, and FIG. 29(*b*) is a perspective view showing a state where the top cover forming flap is folded inward.
Figure 29:
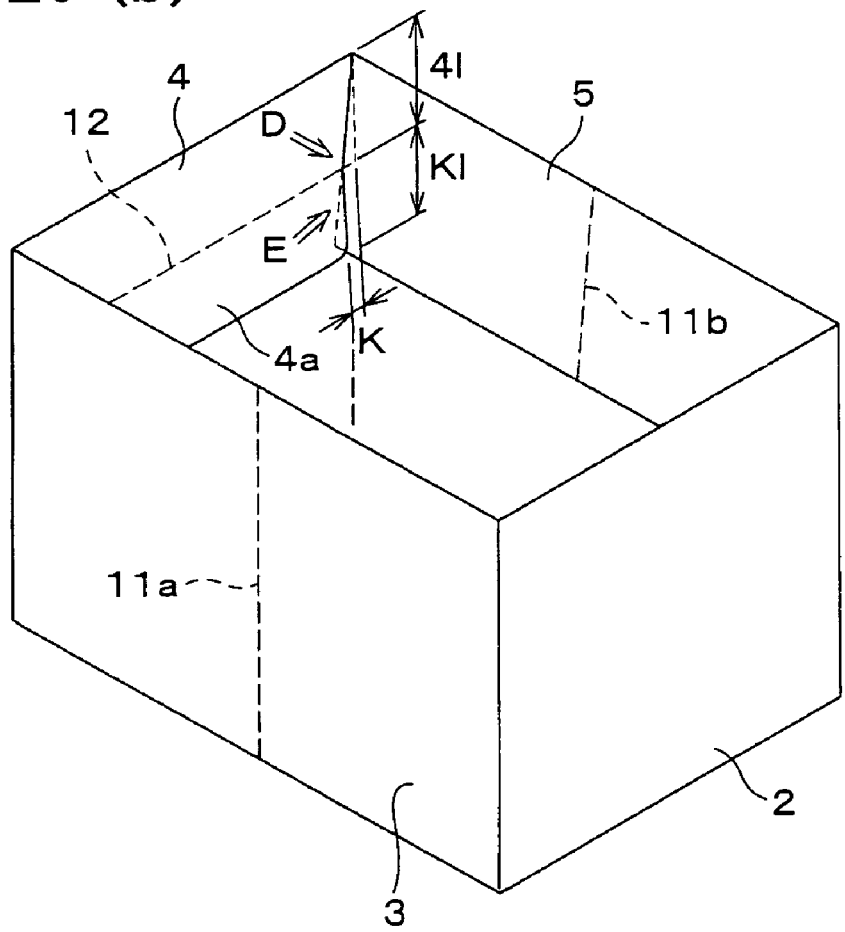

In order to solve this problem, a manner that the slants 37 are not set on the first bottom plate forming flaps 5 can be used. That is, as shown in FIG. 29(*a*), cut parts K are provided ahead of the fold section 12 located between the second bottom plate forming flap 4 and the insertion piece 4*a* so as to make two functional parts, a flap KI part and a flap 4I part, on both sides of the fold section 12. With this arrangement, in forming a bottom plate as shown in FIG. 29(*b*), the second bottom plate forming flaps 4 with slants are first folded inward. Then, in folding the first bottom plate forming flaps 5 without slants, as indicated by an arrow D, the flap 4I part of the second bottom plate forming flap 4 is held down by a substantially half part of the first bottom plate forming flap 5. Further, as indicated by an arrow E, the insertion piece 4*a* is pulled up to keep tight the flap KI part, thereby holding the first bottom plate forming flaps 5. With this manner, it is possible to inwardly fold the second bottom plate forming flaps 4 and the first bottom plate forming flaps 5 without provision of the slants 37 to the first bottom plate forming flaps 5.

Figure 28:
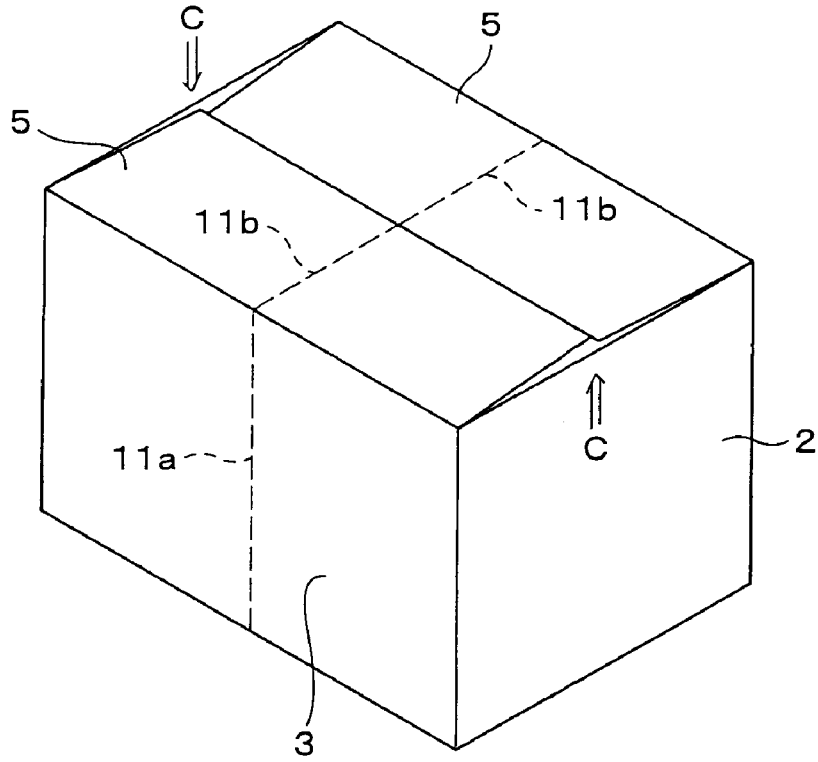
FIG. 28(*a*) is a perspective view showing a problem caused in the case where the respective slants of bottom plate forming flaps are large, and FIG. 28(*b*) is a perspective view showing the packaging container improving the problem shown in FIG. 28(*a*) by other method without providing slants.
Figure 28:
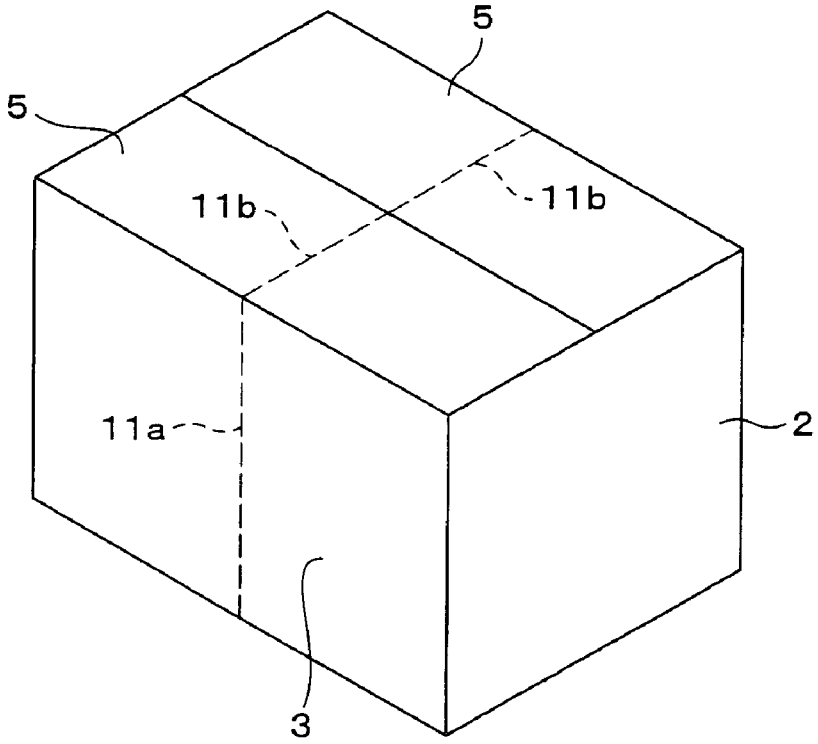

When the first bottom plate forming flaps 5 each having such a shape are folded to form a bottom plate, it is possible to prevent misalignment indicated by the arrow C in FIG. 28(*a*), as shown in FIG. 28(*b*).

Note that, the slants 37 and 38 of the present embodiment are of, but not limited to, substantially straight lines. The slants 37 and 38 may be of curbed lines.

Figure 26:
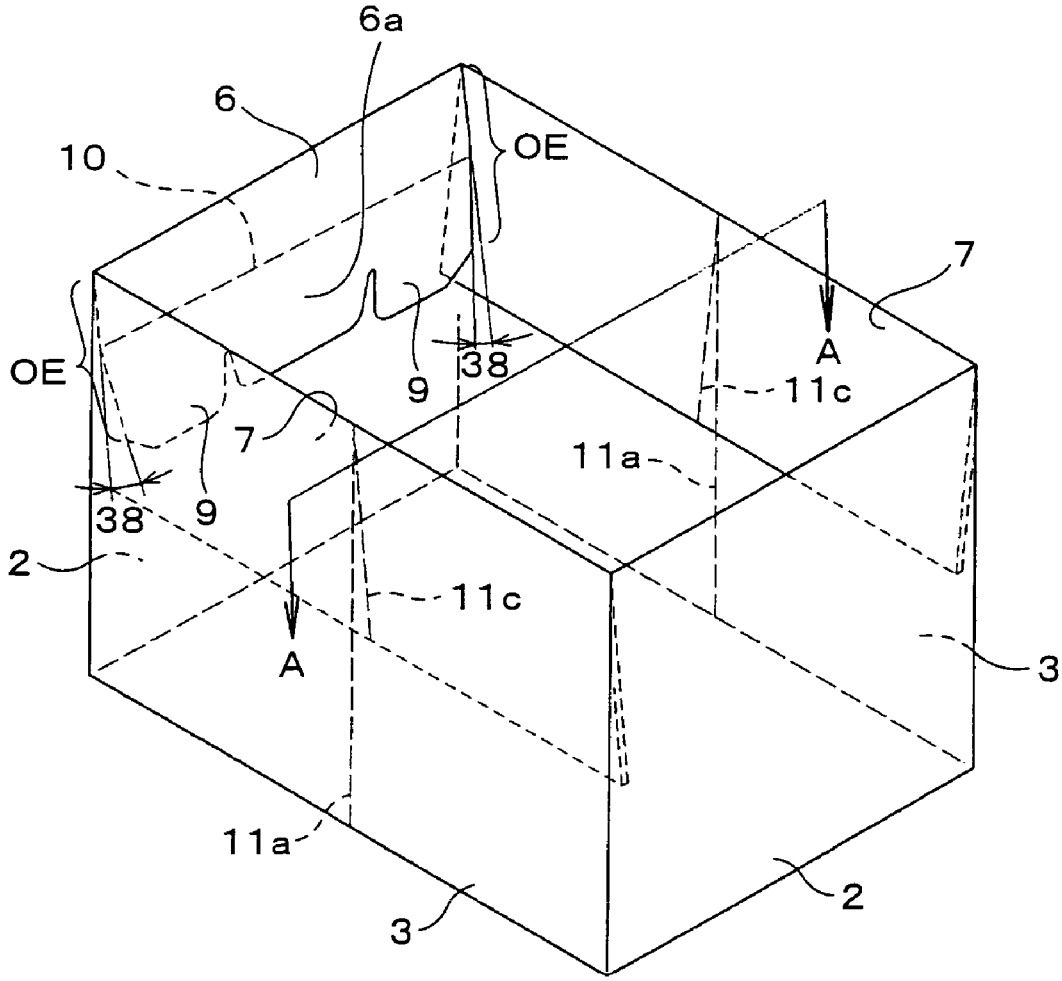
FIG. 26 is a perspective view showing a step of folding first top cover forming flaps with slants and a second top cover forming flap in the packaging container shown in FIG. 22.

Here, when the second top cover forming flaps 6 and the first top cover forming flaps 7 are folded inward until they contact the respective inner surfaces of the second opposing side plates 2 and the first opposing side plates 3, it is preferable that a distance of the slant 38 between a leading end corner part of the top cover forming flap 7 and a leading end corner part of the top cover forming flap 6 which is the closest to the leading end corner part of the top cover forming flap 7 is set to fall within a range from 5 mm to 20 mm, as shown in FIG. 26. Setting a distance of the slant 38 to fall within such a range makes it possible to absorb rebound load parts Z that occur due to thickness of the first top cover forming flaps 7 and reaction of the first top cover forming flaps 7 when the first top cover forming flaps 7 are folded inwardly. This can prevent occurrence of curls 9*a* of the outer edge parts OE of the second top cover forming flaps 6 shown in FIG. 25.

Figure 27:
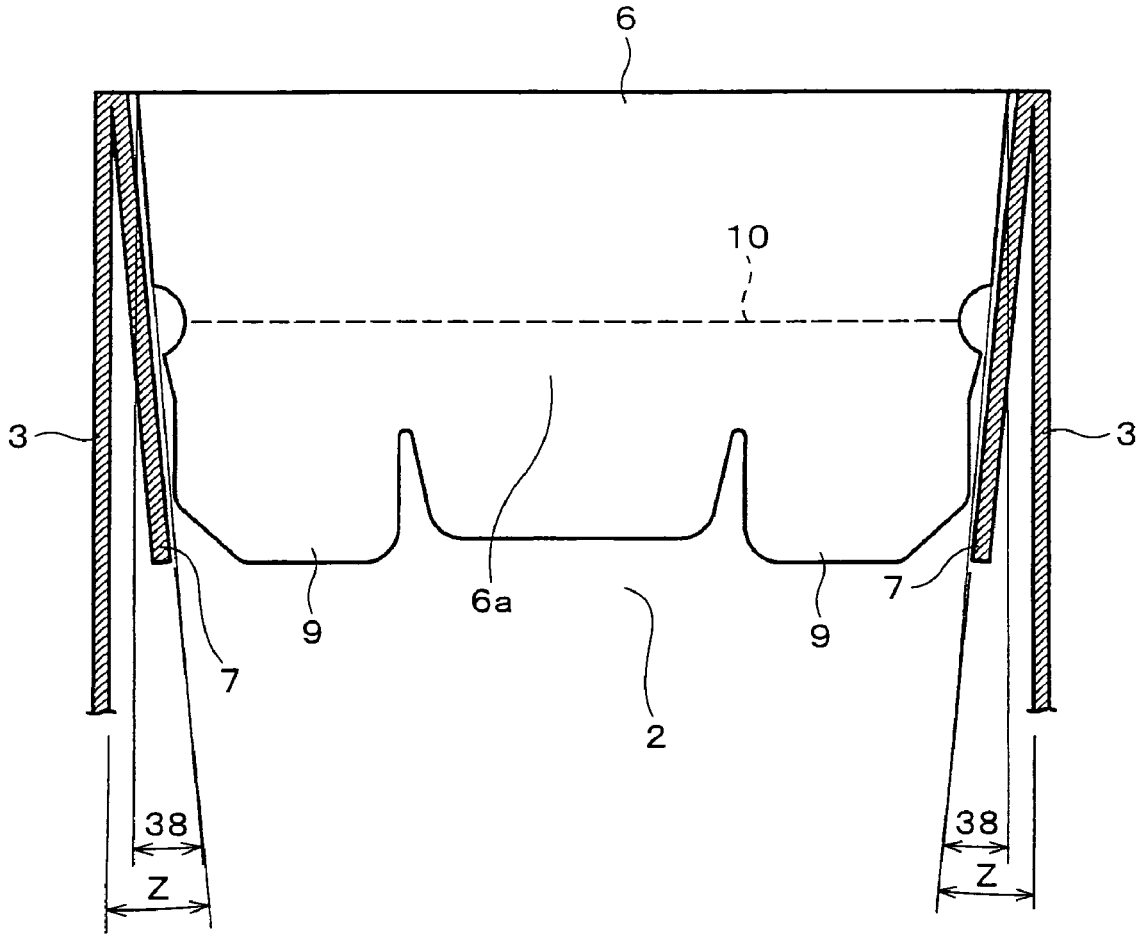
FIG. 27 is a cross-sectional view taken along line A-A of the packaging container shown in FIG. 26.

Further, as shown in FIG. 27, providing the respective slants 37 and 38 to the first top cover forming flaps 7 and the second top cover forming flaps 6 makes it possible to similarly absorb the rebound part Z in folding the second top cover forming flaps 6 after folding the first top cover forming flaps 7 and in folding the first top cover forming flaps 7 after folding the second top cover forming flaps 6. This can prevent occurrence of curls 9*a* of the outer edge parts OE.

The present invention is not limited to the aforementioned embodiments and modified examples and susceptible of various changes within the scope of the accompanying claims. An embodiment obtained by suitable combinations of technical means disclosed in the different embodiments and modified examples also fall within the technical scope of the present invention.

For example, in folding up the packaging container 41, the packaging container 41 can be held by insertion of the insertion piece 6*a* and the insertion piece 4*a* on one side. Also, in folding up the packaging container 41, the packaging container 41 can be held only by insertion of either the insertion piece 6*a* or the insertion piece 4*a*.

Further, for example, in folding the first top cover forming flaps 7 and the first bottom plate forming flaps 5, the first top cover forming flaps 7 and the first bottom plate forming flaps 5 each can be arbitrarily folded on the inward side or the outward side of the opposing side plate 3 connected thereto. A folding style is not limited to inward folding of the opposing side plates 3 and inward folding of the first top cover forming flaps 7 and the first bottom plate forming flaps 5.

Thus, the packaging container of the present invention, which is made of material such as cardboard, includes: a pair of first opposing side plates; a pair of second opposing side plates; bottom plate forming flaps which are connected to respective lower ends of the opposing side plates; and top cover forming flaps which are connected to respective upper ends of the opposing side plates, wherein the first opposing side plate, the bottom plate forming flap connected to the lower end of the first opposing side plate, and the top cover forming flap connected to the upper end of the first opposing side plate are provided with one continuous fold section thereacross centrally in the width direction of the first opposing side plate, and wherein the bottom plate forming flap connected to the lower end of at least one flap of the second opposing side plates and the top cover forming flap connected to the upper end of the at least one flap of the second opposing side plates are provided with respective fold parts substantially in parallel with connection lines to the at least one flap of the second opposing side plates, thereby using a leading end part ahead of the fold section as an insertion piece in folding up the packaging container.

Further, the packaging container of the present invention is arranged so that in the above-described packaging container, a tab provided on the top cover forming flap connected to the upper end of the second opposing side plate is inserted into a slit provided on the top cover forming flap connected to the upper end of the first opposing side plate, thereby forming a top cover.

Further, the packaging container of the present invention is arranged so that in the above-described packaging container, the top cover forming flaps connected to the respective upper ends of the second opposing side plates are first folded, and then, the top cover forming flaps connected to the respective upper ends of the first opposing side plates are folded, thereby forming a top cover.

Still further, the packaging container of the present invention is arranged so that in the above-described packaging container, the bottom plate forming flap and the top cover forming flap which are connected respectively to the lower end and the upper end of the other of the second opposing side plates are folded so as to overlap the inner surface of the other of the second opposing side plates, the bottom plate forming flaps and the top cover forming flaps connected to the respective lower ends and upper ends of the first opposing side plates are folded so as to overlap the respective inner or outer surfaces of the first opposing side plates, and in a state where the first opposing side plate, and the bottom plate forming flap and the top cover forming flap connected to the first opposing side plate are inwardly folded in a form of the letter V along the fold section, the insertion pieces of leading end parts ahead of the respective fold sections provided on the bottom plate forming flap and the top cover forming flap connected respectively to the lower end and upper end of the one of the second opposing side plates are inserted inside the other of the second opposing side plates.

With this arrangement, flaps except for the bottom plate forming flap and the top cover forming flap which are connected respectively to the lower end and the upper end of the one of the second opposing side plates are overlapped the respective opposing side plates connected to the flaps. At this moment, at least the bottom plate forming flap and the top cover forming flap which are connected respectively to the lower end and the upper end of the other of the second opposing side plates are folded so as to overlap the inner surface of the other of the second opposing side plates. In this state, the first opposing side plates, and the bottom plate forming flaps and the top cover forming flaps which are connected respectively to the first opposing side plates are folded inward in the form of the letter V along the respective fold lines, and the insertion pieces are inserted inside the other of the second opposing side plates, thereby holding the state of the packaging container compactly folded up for disposal.

In order to solve the above problem, in a packaging container including a pair of first opposing side plates and a pair of second opposing side plates surrounding a package space, in which first bottom plate forming flaps for forming a bottom plate are connected to respective lower ends of the first opposing side plates, and first top cover forming flaps for forming a bottom plate are connected to respective upper ends of the first opposing side plates, the packaging container includes:

first fold sections for folding therealong, each of the first fold sections being provided longitudinally in a substantially central part of the first opposing side plate;

second fold sections for folding therealong, each of the second fold sections being provided on the first bottom plate forming flap as an extension of the first fold section; and third fold sections for folding therealong, each of the third fold sections being provided on the first top cover forming flap as an extension of the first fold section, the second opposing side plate being equal to or smaller than the first opposing side plate in width.

According to the above invention, in folding up the packaging container, it is possible to fold in the form of the letter V along the respective first fold sections of the first opposing side plates, the respective second fold sections of the first bottom plate forming flaps, and the respective third fold sections of the first top cover forming flaps.

At this moment, in the present invention, the second opposing side plate is equal to or smaller than the first opposing side plate in width, so that it is possible to fold up the packaging container into a decreased area, as compared with the case where the second opposing side plate is larger in width than the first opposing side plate.

Therefore, it is possible to provide a packaging container which can be folded up easily and compactly for disposal as waste, recycling, and other purposes.

Further, the packaging container of the present invention further includes a tongue, which extends from at least one of an upper end or a lower end of the second opposing side plate, for holding a folded state of the packaging container.

In order to solve the above problem, a method for folding up a packaging container in which method the packaging container includes a pair of first opposing side plates and a pair of second opposing side plates, bottom plate forming flaps connected to respective lower ends of the first and second opposing side plates, and top cover forming flaps connected to respective upper ends of the first and second opposing side plates, wherein longitudinal fold sections each is provided across the first opposing side plate, the bottom plate forming flap connected to the lower end of the first opposing side plate, and the top cover forming flap connected to the upper end of the first opposing side plate, the longitudinal fold section being substantially orthogonal to respective connection lines between the first opposing side plate and the bottom plate forming flap and between the first opposing side plate and the top cover forming flap, and wherein a lateral fold section is provided on the top cover forming flap connected to an upper end of at least one of the second opposing side plates, the lateral fold section being substantially parallel to a connection line to the second opposing side plate, is characterized in that after the bottom plate forming flap and the top cover forming flap respectively connected to a lower end and an upper end of the other of the second opposing side plates are folded so as to overlap an inner surface of the other of the second opposing side plates, each of the bottom plate forming flaps and each of the top cover forming flaps respectively connected to the lower end and the upper end of the first opposing side plate are folded so as to overlap an inner or outer surface of the first opposing side plate, and thereafter, while maintaining a state where the first opposing side plate, and the bottom plate forming flap and the top cover forming flap connected to the first opposing side plate are inwardly folded in a form of the letter V along the longitudinal fold section, the bottom plate forming flap connected to the lower end of the at least one of the second opposing side plates and an insertion piece of a leading end part ahead of the lateral fold section of the top cover forming flap connected to the upper end of the at least one of the second opposing side plates are inserted inside the other of the second opposing side plates.

According to the above invention, the tongue for holding a folded state extends from at least one of the upper end and the lower end of the second opposing side plate, so that it is possible to insert the tongue inside the other of the second opposing side plates in the folded packaging container. This maintains a folded state of the packaging container without opening out again by itself.

Similarly, at least one of the second top cover forming flap and the bottom plate forming flap is inserted inside the other of the second opposing side plates. This maintains a folded state of the packaging container without opening out again by itself.

Therefore, it is possible to provide a packaging container and a method for folding up the packaging container which can be folded up easily and compactly for disposal as waste, recycling, and other purposes.

Note that, in the present invention, it is preferable that tongues, or the upper top forming flap and the bottom plate forming flap extends from both of the upper end and the lower end of the second opposing side plate. With this arrangement, two tongues, or the upper top forming flap and the bottom plate forming flap are inserted inside the other of the second opposing side plate in the packaging container, which surely maintains a folded state of the packaging container without opening out again by itself.

Further, in the packaging container of the present invention, which is the above-described packaging container, includes an explanation section, which is provided on at least one of the second opposing side plates, for explaining how to fold up the packaging container.

Still further, in the method for folding up the packaging container of the present invention, which is the above-described method for folding up the packaging container, the packaging container includes an explanation section, which is provided on at least one of the second opposing side plates, for explaining how to fold up the packaging container.

According to the above invention, it is possible to fold up the packaging container while referring to the explanation section showing how to fold up the packaging container, facilitating folding operation of the packaging container. In addition, the explanation section is provided on at least one of the second opposing side plates, so that the explanation section without being disappeared can be referred to until folding operation of the packaging container is completed, ensuring the packaging container to be folded up.

Yet further, the packaging container of the present invention, which is the above-described packaging container, includes a mark section for specifying a part to be folded, the mark section being provided in at least one of an end part of the first fold section on the first opposing side plate, an end part of the second fold section on the first bottom plate forming flap, and an end part of the third fold section on the first top cover forming flap.

Further, in the method for folding up the packaging container of the present invention, which is the above-described method for folding up the packaging container, the packaging container includes a mark section for specifying a part to be folded, the mark section being provided on the longitudinal fold section provided across the first opposing side plate, the bottom plate forming flap connected to the lower end of the first opposing side plate, and the top cover forming flap connected to the upper end of the first opposing side plate.

According to the above invention, referring to the mark section facilitates checking a position for folding. In addition, the mark section is provided in an end part of the first fold section on the first opposing side plate, an end part of the second fold section on the first bottom plate forming flap, or an end part of the third fold section on the first top cover forming flap. Because of this, the mark section appears at an easily viewable position.

Still further, in the packaging container of the present invention, which is the above-described packaging container, a length of the second top cover forming flap is substantially equal to a length of the first top cover forming flap, and at least one flap of the first and second top cover forming flaps has a gradually decreasing width with increase in length extending from the upper end of the second opposing side plate.

According to the above invention, the length of the second top cover forming flap is substantially equal to the length of the first top cover forming flap. This makes it possible to reduce paper excess parts caused by difference in length between the second top cover forming flap and the first top cover forming flap.

In addition, this arrangement causes no breaks in the paper excess part during the course of distribution for the packaging container, allowing stability in quality of the packaging container.

Moreover, the flap is provided so as to have a gradually decreasing width with increase in length extending from the upper end of the opposing side plate. Because of this, when the first top cover forming flaps and the second top cover forming flaps are folded until they contact the respective inner surfaces of the two pairs of opposing side plates, the outer edge parts of the second top cover forming flaps can resist rebound of the first top cover forming flaps.

This can facilitate inwardly folding these top cover forming flaps regardless of a folding order. In addition, since the rebound can be resisted, it is possible to surely hold the folded state of the packaging container in folding up the packaging container.

Still further, in the packaging container of the present invention, which is the above-described packaging container, when the first and second top cover forming flaps are folded until contacting respective inner surfaces of the first and second opposing side plates, a distance when leading end corner parts of the first and second top cover forming flaps are the closest to each other is set to fall within a range from 5 mm to 20 mm.

According to the above invention, it is surely possible to absorb rebound load parts that occur due to thickness of the top cover forming flaps and reaction of the top cover forming flaps when the top cover forming flaps are folded inwardly. This can prevent occurrence of curls of the outer edge parts of the top cover forming flaps.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A packaging container, comprising:

a pair of first opposing side plates;

a pair of second opposing side plates, an inner surface of the pair of first opposing side plates and an inner surface of the pair of second opposing side plates surrounding a package space in a developed state;

a pair of first bottom plate forming flaps for forming a bottom plate, each of the first bottom plate forming flaps being connected to a lower end of a respective one of the pair of first opposing side plates; and a pair of first top cover forming flaps for forming a top plate, each of the first top cover forming flaps being connected to an upper end of a respective one of the pair of first opposing side plates, wherein the first opposing side plates are each respectively provided with a longitudinal fold section thereacross so as to cross a substantially central part of the respective first opposing side plate, each of the respective longitudinal fold sections extending continuously across the respective first bottom plate forming flap and the respective first top cover forming flap, the first opposing side plates being folded at the longitudinal fold sections to place the packing container in a collapsed state, and wherein at least one of a second bottom plate forming flap and a second top cover forming flap which are respectively connected to a lower end and an upper end of at least one of the pair of second opposing side plates is provided with a lateral fold section which is substantially parallel to a connection line between the at least one second opposing side plate and the at least one flap, the lateral fold section defining a leading end part, and wherein, in the collapsed state, the leading end part, formed by folding the at least one of the second bottom plate forming flap and the second top cover forming flap at the lateral fold section, makes contact with and engages the inner surfaces of the folded opposing first opposing side plates to maintain the collapsed state.

2. The packaging container according to claim 1, wherein:

each of the first top cover forming flaps connected to the upper ends of the first opposing side plates is provided with a slit, and the second top cover forming flap connected to the upper end of at least one of the second opposing side plates is provided with a tab for inserting into the slit to hold the first and second top cover forming flaps when the packaging container is assembled.

3. The packaging container according to claim 1, wherein:

a length of the second top cover forming flap is substantially equal to a length of at least one the pair of first top cover forming flaps, and at least one flap of the pair of first top cover forming flaps and the second top cover forming flap has a gradually decreasing width with increase in length extending from the upper end of a respective first or second opposing side plate.

4. The packaging container according to claim 3, wherein:

when the first and second top cover forming flaps are folded until contacting respective inner surfaces of the first and second opposing side plates, a distance when leading end corner parts of the first and second top cover forming flaps are the closest to each other is set to fall within a range from 5 mm to 20 mm.

5. The packaging container according to claim 1, wherein:

a pair of second top cover forming flaps extend from respective upper ends of the pair of second opposing side plates, a length of one of the pair of second top cover forming flaps is substantially equal to a length of one of the pair of first top cover forming flaps, and at least one flap of the first pair of first top cover forming flaps and the pair of second top cover forming flaps has a gradually decreasing width with increase in length extending from the upper end of a respective first or second opposing side plate.

6. The packaging container according to claim 5, wherein:

when the first and second top cover forming flaps are folded until contacting respective inner surfaces of the first and second opposing side plates, a distance when leading end corner parts of the first and second top cover forming flaps are the closest to each other is set to fall within a range from 5 mm to 20 mm.

7. The packaging container according to claim 1, wherein:

the first opposing side plates are folded towards an inside of the packaging container along the longitudinal fold section.

8. A packaging container, comprising:

a pair of first opposing side plates;

a pair of second opposing side plates, an inner surface of the pair of side opposing side plates and an inner surface of the pair of second opposing side plates surrounding a package space in a developed state;

a pair of first bottom plate forming flaps for forming a bottom plate, each of the first bottom plate forming flaps being connected to a lower end of a respective one of the pair of first opposing side plates;

a pair of first top cover forming flaps for forming a top plate, each of the first top cover forming flaps being connected to an upper end of a respective one of the pair of first opposing side plates;

first fold sections for folding therealong, each of the first fold sections being provided longitudinally in a substantially central part of the first opposing side plates;

second fold sections for folding therealong, each of the second fold sections being provided on a respective one of the pair of first bottom plate forming flaps as an extension of a respective first fold section; and third fold sections for folding therealong, each of the third fold sections being provided on a respective one of the pair of first top cover forming flaps as an extension of a respective first fold section;

wherein, the pair of first opposing side plates, the pair of first bottom plate forming flaps, and the pair of first top cover forming flaps being folded at the first fold sections, the second fold sections, and the third fold sections, respectively, to place the packing container in a collapsed state, wherein at least one of a second bottom plate forming flap and a second top cover forming flap which are respectively connected to a lower end and an upper end of at least one of the pair of second opposing side plates is provided with a lateral fold section which is substantially parallel to a connection line between the at least one second opposing side plate and the at least one flap, the lateral fold section defining a leading end part, and wherein, in the collapsed state, the leading end part, formed by folding at least one of the second bottom plate forming flap and the second top cover forming flap at the lateral fold section, makes contact with and engages the inner surfaces of the folded opposing first opposing side plates and makes contact with and engages one of the second bottom plate forming flap and the second top cover forming flap which are folded inside and are connected to the opposing second opposing side plates to maintain the collapsed state.

9. The packaging container according to claim 8, further comprising:

an explanation section, which is provided on at least one of the second opposing side plates, for explaining how to fold up the packaging container.

10. The packaging container according to claim 8, further comprising:

a mark section for specifying a part to be folded, the mark section being provided in at least one of (i) an end part of a first fold section on at least one of the pair of first opposing side plates, (ii) an end part of a second fold section on at least one of the pair of first bottom plate forming flaps, and (iii) an end part of a third fold section on at least one of the pair of the pair of first top cover forming flaps.

11. The packaging container according to claim 8, wherein:

the first opposing side plates are folded towards an inside of the packaging container along the longitudinal fold section.

12. The packaging container according to claim 8, wherein:

the second opposing side plate are equal to or smaller than the first opposing side plates in width.

13. A method for folding up a packaging container that includes, a pair of first opposing side plates, a pair of second opposing side plates including a first plate and a second plate opposing the first plate, bottom plate forming flaps connected to respective lower ends of the first and second opposing side plates, top cover forming flaps connected to respective upper ends of the first and second opposing side plates, and longitudinal fold sections provided across the first opposing side plates, the bottom plate forming flaps connected to the lower end of the first opposing side plates, and the top cover forming flaps connected to the upper end of the first opposing side plates, the longitudinal fold sections being substantially orthogonal to respective connection lines between the first opposing side plates and the bottom plate forming flaps and between the first opposing side plates and the top cover forming flaps; and a lateral fold section provided on at least one of a top cover forming flap connected to an upper end of the first plate and a bottom cover forming flap connected to a bottom end of the first plate, the lateral fold section being substantially parallel to a respective connection line between the first plate and the top cover forming flap and the bottom cover forming flap connected to the first plate, the lateral fold section defining an insertion piece, the method comprising:

folding a bottom plate forming flap and a top cover forming flap respectively connected to a lower end and an upper end of the second plate so as to overlap an inner surface of the second plate;

folding each of the bottom plate forming flaps and each of the top cover forming flaps respectively connected to the lower ends and the upper end of the first opposing side plates so as to overlap inner or outer surfaces of the first opposing side plates;

folding the first opposing side plates, the bottom plate forming flaps connected to the first opposing side plates and the top cover forming flaps connected to the first opposing side plates along the longitudinal fold sections towards an inside of the packaging container in a form of the letter V to place the packing container in a collapsed state; and maintaining the collapsed state by inserting the insertion piece between a gap defined by the folded bottom plate forming flap or the folded top cover forming flap connected to the second plate, and also defined by inner surfaces of the folded first opposing side plates or one of the folded bottom forming flaps and the folded bottom forming flaps connected to the first opposing side plates.

14. The method according to claim 13, wherein:

the packaging container includes an explanation section, which is provided on at least one of the second opposing side plates, for explaining how to fold up the packaging container.

15. The method according to claim 13, wherein:

the packaging container includes a mark section for specifying a part to be folded, the mark section being provided on at least one of the longitudinal fold sections provided across the first opposing side plates, the bottom plate forming flaps connected to the lower end of the first opposing side plates, and the top cover forming flap connected to the upper end of the first opposing side plates.

16. A method for folding up a packaging container that includes, a pair of first opposing side plates, a pair of second opposing side plates, bottom plate forming flaps connected to respective lower ends of the first and second opposing side plates, top cover forming flaps connected to respective upper ends of the first and second opposing side plates, and longitudinal fold sections provided across the first opposing side plates, the bottom plate forming flaps connected to the lower end of the first opposing side plates, and the top cover forming flaps connected to the upper end of the first opposing side plates, the longitudinal fold sections being substantially orthogonal to respective connection lines between the first opposing side plates and the bottom plate forming flaps and between the first opposing side plates and the top cover forming flaps; and a lateral fold section provided on a top cover forming flap connected to an upper end of at least one of the second opposing side plates and a bottom cover forming flap connected to a lower end of said at least one of the second opposing side plates, the lateral fold section being substantially parallel to a respective connection line between a respective one of the second opposing side plates and the flap on which the lateral fold section is provided, the lateral fold section defining an insertion piece, the method comprising:

folding a bottom plate forming flap and a top cover forming flap respectively connected to a lower end and an upper end of the other of the second opposing side plates so as to overlap an inner surface of said the other of the second opposing side plates;

folding each of the bottom plate forming flaps and each of the top cover forming flaps respectively connected to the lower ends and the upper end of the first opposing side plates so as to overlap inner or outer surfaces of the first opposing side plates;

folding the first opposing side plates, the bottom plate forming flaps connected to the first opposing side plates and the top cover forming flaps connected to the first opposing side plates along the longitudinal fold sections towards an inside of the packaging container in a form of the letter V to place the packing container in a collapsed state; and maintaining the collapsed state by inserting the insertion piece between a gap defined by the folded bottom plate forming flap or the folded top cover forming flap connected to said the other of the second opposing side plates, and also defined by inner surfaces of the folded first opposing side plates or one of the folded bottom forming flaps and the folded bottom forming flaps connected to the first opposing side plates.

* * * * *